US007241193B2

(12) United States Patent
Jordan

(10) Patent No.: US 7,241,193 B2
(45) Date of Patent: Jul. 10, 2007

(54) VARIABLE MARINE JET PROPULSION

(76) Inventor: Jeff P. Jordan, 4805 - 158th Ct. NE., Redmond, WA (US) 95082

( * ) Notice: Subject to any disclaimer, the term of this patent is extended or adjusted under 35 U.S.C. 154(b) by 31 days.

(21) Appl. No.: 11/150,336

(22) Filed: Jun. 10, 2005

(65) Prior Publication Data

US 2006/0281375 A1 Dec. 14, 2006

(51) Int. Cl.
*B63H 11/00* (2006.01)

(52) U.S. Cl. ..... 440/38; 440/47; 440/50; 440/67

(58) Field of Classification Search ..... 440/38, 440/46, 47, 67; 416/43, 131; 114/151
See application file for complete search history.

(56) References Cited

U.S. PATENT DOCUMENTS

| | | | | |
|---|---|---|---|---|
| 1,600,654 | A | 9/1926 | Stodder | |
| 3,260,311 | A | 7/1966 | Kovates | |
| 3,302,725 | A * | 2/1967 | Brimble et al. | 416/43 |
| 3,575,530 | A * | 4/1971 | Hall | 416/131 |
| 3,939,794 | A | 2/1976 | Hull | |
| 4,509,925 | A | 4/1985 | Wuhrer | |
| 5,310,316 | A | 5/1994 | Arbeus | |
| 5,324,216 | A | 6/1994 | Toyohara et al. | |
| 5,658,176 | A | 8/1997 | Jordan | |
| 5,679,035 | A | 10/1997 | Jordan | |
| 5,683,276 | A | 11/1997 | Jordan | |
| 5,810,561 | A * | 9/1998 | Cossette | 416/43 |
| 5,910,032 | A | 6/1999 | Gruenwald et al. | |
| 5,975,966 | A | 11/1999 | Lin | |
| 6,102,757 | A * | 8/2000 | Ishigaki | 440/47 |
| 6,293,836 | B1 | 9/2001 | Blanchard | |
| 6,422,904 | B1 | 7/2002 | Davies et al. | |
| 6,500,035 | B2 * | 12/2002 | Terlouw | 440/38 |
| 6,857,920 | B2 | 2/2005 | Marathe et al. | |
| 6,881,110 | B1 | 4/2005 | Abdel-Maksoud et al. | |

* cited by examiner

*Primary Examiner*—Lars A. Olson
(74) *Attorney, Agent, or Firm*—Charles J. Rupnick

(57) ABSTRACT

A variable marine jet propulsion system incorporates a motor, a variable-pitch propeller pump in a spherical housing, a variable housing and a variable inlet duct, and a microcontroller. The pump, the nozzle and the inlet are controlled by the microcontroller, which is programmed to control the pump as a continuously variable power transmission for maintaining efficient motor operation, the nozzle for maintaining efficient pump operation, and the inlet for maintaining efficient recovery of the total dynamic head of the incoming water. The spherical pump housing maintains close fits to the propeller vane tips for more efficient operation at all pitches, including zero and reverse pitches. Zero pitch results in no effective pumping action, effectively a true neutral in fluid power transmission. Reverse pitch in combination with the large variable nozzle provides reverse flow and consequently reverse thrust, which eliminates the need for the "backing bucket".

21 Claims, 11 Drawing Sheets

VARIABLE MARINE JET PROPULSION

The present invention claims priority benefit of International Patent Application Number PCT/US2003/039296 filed in the name of Jeff Jordan, the same inventor as the inventor of the present application, on Dec. 10, 2003, which claims priority benefit of Provisional Patent Application Ser. No. 60/432,281 filed also in the name of Jeff P. Jordan on Dec. 10, 2002, the complete disclosures of which are incorporated herein by reference.

TECHNICAL FIELD

This invention relates to Marine Jet Propulsion Systems, and more particularly to such systems of an improved design, which are more efficient over a range of vessel speeds and loads.

BACKGROUND ART

A marine jet propulsion system includes an inlet duct, a pumping means and a nozzle. The inlet duct delivers water from under the hull to the pumping means, which is driven by an engine. The pumping means delivers the water through the nozzle, which produces a water jet, thereby propelling the watercraft through the body of water in which the watercraft moves. In the prior art, a reversing bucket redirects the jet flow back under the boat fully for reverse thrust and partially for neutral thrust.

My U.S. Pat. Nos. 5,658,306, 5,679,035 and 5,683,276, which are incorporated by reference, disclose systems and methods for simultaneously optimizing the hydraulic efficiency of the inlet duct and the pumping means. Such increased hydraulic efficiency has allowed a substantial increase in the design system flow rate, which is well understood in the propulsion field of art to improve propulsion efficiency at low watercraft speeds. The increased hydraulic efficiency of the system and the methods preserves propulsion efficiency at higher watercraft speeds, so that the systems operate more efficiently over a wide range of boat speeds and accelerations.

From disclosures in my US Patents and through common knowledge in the propulsion field of art, it is known that larger mass flow rates and concomitantly lower nozzle velocities are more efficient at lower watercraft speeds, whereas lower mass flow rates and concomitantly higher nozzle velocities are more efficient at higher watercraft speeds. To achieve these ends, it is well understood in the art that a larger nozzle area is useful at low watercraft speeds, whereas a smaller nozzle area is most useful at higher watercraft speeds. Such reduction of nozzle size with watercraft speed was a natural consequence of the operation of the systems and the methods disclosed in my US Patents. However, a greater reduction of nozzle size with watercraft speed would be desirable for increased propulsion efficiency over a range of watercraft speeds.

When the watercraft is operating in a planing mode, the water jet obliquely strikes the water surface behind the watercraft, which results in turbulence on the water surface. Such turbulence is dependent on the velocity of the water jet relative to the water surface. When the velocity of the water jet relative to the water surface is high, as is common in the prior art, the water jet interacts with the water surface to produce a high turbulent spray of water behind the boat, which is commonly called a "rooster tail." The rooster tail is commonly considered objectionable for water skiing and wakeboarding behind the watercraft. Reducing the velocity of the water jet relative to the water surface eliminates the rooster tail, but still leaves a turbulent trail of surface water in the wake of the watercraft, which is still objectionable to wake boarders, who like to use short ropes. A further reduction of the velocity of the water jet relative to the water surface would be desirable for the further reduction of the turbulent trail of surface water in the wake of the watercraft.

Another shortcoming of the prior art is the fact that the engine commonly operates at substantially higher rpm than would be most efficient, which results in greater fuel consumption, greater engine wear, and more noise than would result from operation at the engine's most efficient rpm. The operation of such systems in the prior art has been made more efficient by incorporating a two-speed transmission, but at higher cost, weight and axial length.

Many marine jet propulsion systems of the prior art feature a direct connection between the pump and the engine to eliminate the cost and axial length of a transmission or clutch. In these designs of the prior art, the neutral position that could be provided by the transmission or clutch is approximated by partially reversing the flow from the jet. The operator cannot easily maintain the balance of this partial reversing, especially given the sudden surge when starting the engine, so that the watercraft moves unpredictably. A true neutral control position would be desirable to enhance the operator's control of the watercraft.

Trash management is another shortcoming of the marine propulsion systems of the prior art. Many types of floating debris can become lodged on the grate that covers the inlet of the system, which restricts the flow of water into the pump and reduces propulsion efficiency. There are three types of such debris: solid objects, like rocks; fibrous material, like rope, fishing line, grass, reeds, and the stems of aquatic plants; and sheet material that can blind large sections of the grate, like large kelp leaves and plastic bags. The fibrous material is also well known to lodge on the leading edges of pump and stator vanes, reducing pump efficiency. The rope is particularly difficult to disentangle, when it becomes wrapped around the impeller and the drive shaft. Some jet boats carry hand rakes with right angle bends in the handle to remove debris from the inlet grate, and some integrate moveable grate sections to remove such debris, but these methods are awkward and only partially effective. Some commercial water jet propulsion systems are equipped with a reversing transmission, which is used to back flush both the pump vanes and the grate. As a last resort, commercial systems and river boats are commonly equipped with a clean-out hatch, which can be removed to allow the operator to remove debris from the pump inlet by hand. It would be desirable to reduce or eliminate the need for the trash handling mechanisms and methods by providing trash handling and back flushing methods integral to the design of the marine jet propulsion system.

In the marine jet propulsion systems of the prior art, reverse thrust is achieved by redirecting the water jet back under the boat along hydraulic reaction surfaces. Such reaction surfaces are commonly carried on a structure known as a "bucket", which is mechanically moved into the jet stream by the operator to get reverse thrust. Buckets for large jets take up considerable space and add weight and cost to the system. It would be desirable to eliminate the need for the bucket by incorporating a method of producing reverse thrust in the pump design.

DISCLOSURE OF THE INVENTION

Accordingly, it is an object of the invention to provide an improved marine jet propulsion system, which combines a variable pitch pump impeller and a variable nozzle under microcontroller controls to create a continuously variable power transmission, so that the engine is always operating close to its most efficient rpm.

It is a further object of the invention to use full pitch on the variable pitch pump impeller and maximum nozzle area on the variable nozzle at low speeds, which both increases propulsion efficiency and reduces the turbulent trail of surface water in the wake of the watercraft.

It is a further object of the invention to reduce the variable-pitch impeller pitch and the variable nozzle area with increasing watercraft speeds, so that both the impeller pitch and the nozzle area are minimum at the top boat speed, which is well understood in the art to increase propulsion efficiency.

It is a further object of the invention to maintain the variable pitch impeller pump close to its most efficient operating conditions over both a wide range of shaft rpm and a wide range of watercraft speeds, while simultaneously achieving the objects and advantages stated above.

It is a further object of the invention to achieve these objects and advantages in combination with a variable inlet duct, that efficiently converts excess velocity at the duct entrance into pressure at the pump inlet, as described in my U.S. Pat. No. 5,683,276.

It is a further object of the invention to incorporate a novel pump design, which allows the variable pitch to be reduced to near zero, which results in no effective pumping action, which is effectively a true neutral power transmission.

It is a further object of the invention to provide a method of further varying the pitch of the variable pitch impeller pump to create a reverse pumping action, which provides grate and vane cleaning by back flushing the system.

It is a further object of the invention to provide a vane design method, which results in close tolerances between the leading edges and the trailing edges of the vanes as they rotate through zero pitch, which results in a scissoring action between the leading edges and the trailing edges of the vanes, which effectively cleans the leading edges of the vanes. The scissoring action will also be seen to be effective in cutting rope and fishing line that may be sucked into the system, and it can be used to effectively chop up larger pieces of debris in the pump inlet into smaller pieces, which can escape through the grating or the nozzle.

It is a further object of the invention to provide for the further variation of the variable pitch vanes to produce a reverse pumping action through the system, which becomes an effective reverse thrust when controlled in concert with the variable inlet and the variable nozzle, thereby eliminating the need for the reversing bucket.

It is a further object of the invention to utilize the same nozzle vanes for reverse steering as are used for forward steering and nozzle flow regulation.

SUMMARY

These and other objects are met by providing an improved marine jet propulsion system, which combines a novel variable pitch spherical pump impeller and a variable steering nozzle to create a continuously variable power transmission, so that the engine is always operating close to its most efficient rpm. Reducing the pitch on the variable pitch spherical pump to near zero provides a neutral power transmission. Further reducing the pitch results in a scissoring action between the pump vanes, which cleans debris off the leading edges of the vanes. Further reducing the pitch results in reverse pitch and in reversing the pump flow, which back flushes the system for trash removal. Further reducing the pitch results in a reverse pumping action, which is an effective reverse thrust, particularly when used in concert with the variable steering nozzle and in concert with the variable inlet duct, which can act as a reverse nozzle. The swim platform and power trim function, which are both common on recreational boats of the prior art, can be used to reduce vortex formation and cavitation in the reverse thrust mode.

The variable pitch spherical pump incorporates concentric spherical surfaces on the impeller hub and on the pump housing. The axes of rotation of the variable pitch impeller vanes are radii of the concentric spherical surfaces, and the inner and outer edges of the variable pitch impeller vanes are also spherical surfaces, which fit closely to the spherical surfaces of the impeller hub and of the pump housing, respectively. This geometry allows the variable pitch impeller vanes to rotate about the axes of rotation, while constantly maintaining close fits between the inner and outer edges of the vanes and the impeller hub and the pump housing, respectively. The close fits are well known in the pump design field of art to contribute to efficient pump operation. In particular, this geometry allows the vanes to rotate to near zero pitch required for effectively neutral power transmission, while providing close fits at the full pitch required in any application. It also allows the vanes to rotate fully into reverse pitch, while maintaining the close fits, which is well understood to result in a reverse pumping action, which is useful for back flushing trash and for providing reverse thrust.

In the forward thrust mode of operation, the variable nozzle is controlled to maintain the most efficient head on the variable pitch impeller pump for the current shaft rpm, as is described in my U.S. Pat. No. 5,679,035. It is well understood in the art that the most efficient head on the variable pitch impeller pump is largely dependent on the square of the shaft rpm. It is also well understood in the art that the most efficient head on the variable pitch impeller pump is only very slightly dependent on impeller pitch. Hence, the pump will always be operating close to peak efficiency, when the variable nozzle is controlled to maintain pump head as a function of square of the shaft rpm.

It is well understood in the art that efficiency is nearly constant over a broad range of impeller pitch. The resulting flow through the pump is well understood to be a function of the impeller pitch. The shaft power demand of the pump is well understood to be directly dependent on the product of pump head and flow, when efficiency is constant. From this, it is clear that varying the impeller pitch varies the pump shaft power demand. It is further clear that this variation of power demand occurs without significant loss of efficiency, when most efficient pump head is simultaneously maintained by varying nozzle area. It will also be clear to those schooled in the art that knowledge of instantaneous pump head and shaft rpm can be used to compute the system flow by means of the pump affinity constants, and hence the shaft power demand of the pump. It will also be clear to those schooled in the art that knowledge of actual system flow can be compared to the flow indicated by pump head and shaft rpm to monitor the efficiency of the pump operation, which can be used to alert the operator of pump inefficiency, which is probably due to debris on the inlet grate or on the pump vanes.

A microcontroller incorporates inputs from differential pressure transducers to determine the head on the pump and the flow through the system. The microcontroller gets an rpm input from an engine tachometer. The control program in the microcontroller incorporates a look-up table of the pump efficiency as a function of shaft rpm. From these inputs the control program determines the shaft power demand of the pump. The control program also incorporates a look-up table, which allows interpolation of the most efficient power supplied at each shaft speed by the engine, as is well understood in the art of industrial controller programming. The control program compares the calculated pump power demand to the power most efficiently supplied by the engine at the input rpm, and adjusts the pitch on the variable pitch impeller to adjust pump shaft power demand to approximate the most efficient power supply of the motor at the input rpm. Simultaneously, the variable steering nozzle is adjusted to maintain the pump at its most efficient operating head for the shaft rpm.

In an alternate embodiment, the pitch on the variable pitch impeller is controlled by reference only to the throttle position on the engine. The efficient power supplied by the motor is largely dependent on the throttle position, and the pump power demand is largely dependent on impeller pitch, so linking the impeller pitch to the throttle position approximately maintains efficient engine operation. Simultaneously, the variable steering nozzle is adjusted to maintain the pump at its most efficient operating head for the shaft rpm.

In another alternate embodiment, the pitch on the variable pitch impeller is adjusted based on an engine loading output from a combustion microcontroller on the engine. It is well understood that such combustion microcontrollers commonly use a variety of sensors on the engine to control fuel injection, ignition timing and electric servo valve timing. Such combustion microcontrollers also commonly output engine-loading signals to automobile transmission microcontrollers, which incorporate engine conditions into their shift point control calculations. By these means, variations in elevation, humidity, fuel quality, and other engine operating parameters are incorporated in the most efficient shift point control decisions, so that the engine operates most efficiently. Similarly, this alternate embodiment adjusts the impeller pitch to operate the engine most efficiently. Simultaneously, the variable steering nozzle is adjusted to maintain the pump at its most efficient operating head for the shaft rpm. It will be clear from the following disclosure that several fortunate consequences result from this pump and nozzle design and from these control methods.

When the watercraft is at the dock, the operator can manually control the pitch on the variable pitch impeller to be effectively zero, so that no pumping action results from the rotation of the variable pitch impeller. This is a true neutral position for starting the engine and for sitting at rest in the water. The operator can also reverse the pitch to clean the vanes and to back flush the system. By increasing the pitch, the operator increases the flow through the jet in a controllable way, either in forward or reverse, eliminating any starting jerks or uncontrollable movement of the watercraft. The same steering wheel or other steering control method is effective in steering the boat in either forward or reverse. When the operator has set the impeller at full forward pitch and increases the engine rpm, the microcontroller maintains efficient operation, as described above.

At low speeds, the power demanded to propel the boat at constant speed is low. To match the power demanded by the pump to the most efficient rpm of the engine, the microcontroller sets the pump impeller pitch near maximum. To maintain the pump close to its most efficient operating conditions, the microcontroller opens the variable steering nozzle to maximum. In addition to maintaining engine efficiency, this control strategy has the fortunate consequence of providing maximum flow at low speeds for maximum propulsion efficiency. The flow through the maximum nozzle opening also occurs at the lowest possible velocity. Thus, motor efficiency, pump efficiency, and flow rate efficiency are all close to optimum, and wake turbulence is minimized.

When the system is under full acceleration, as in pulling up a water skier, the control system will reduce the pump impeller pitch to match the pump's shaft power demand to the engine's most efficient power supply at the instantaneous shaft rpm. The control system will also reduce the nozzle area to maintain the most efficient head on the pump for its current rpm.

When the boat reaches steady wakeboarding speed in the approximate range of 15 to 20 mph, the impeller is close to full pitch to reduce the engine rpm to the most efficient operating point. The variable nozzle is close to being fully open to maintain the most efficient pump head at the relatively low shaft rpm. A further advantage is that the variable inlet duct opening is near maximum due to the high flow, which results in no losses from the conversion of inlet entrance velocity to pressure at the pump inlet. This again has the fortunate consequence of providing close to maximum flow at this relatively low boat speed for maximum propulsion efficiency, which also results in minimum nozzle velocity through the large nozzle area and consequently in minimum wake turbulence. The system rpm is further reduced relative to systems of the prior art by this higher propulsion efficiency, which requires less shaft power and consequently lower shaft rpm to maintain the boat speed. Thus, motor efficiency, pump efficiency, and flow rate efficiency are all close to optimum, and wake turbulence is minimized.

When the boat reaches steady water skiing speed at approximately 30 mph, the recovery of pressure in the inlet duct has increased, which will cause a slight reduction in nozzle area to maintain the most efficient system flow and head on the pump. The power required to maintain this higher boat speed is also higher, so the engine must operate at a higher rpm to supply the necessary power. The most efficient pump head rises as the square of the shaft rpm. Higher engine rpm causes the control system to reduce the impeller pitch, which reduces the most efficient pump flow. The nozzle area control function implicitly accounts for higher inlet head at this boat speed, higher pump head at the higher shaft rpm, and the reduced flow resulting from reduced impeller pitch. As a result of all these factors, the nozzle area is reduced and the nozzle velocity relative to the boat is increased. However, the nozzle velocity relative to the water surface is reduced by the increased boat speed, so that the velocity of the jet relative to the water surface has only slightly increased. Wake turbulence is thereby only slightly increased, and the use of longer towropes at this higher boat speed makes wake turbulence less critical, since it has more time to dissipate before the skier reaches it.

Further increases in boat speed demand increased engine power, which the engine can only supply at higher rpm. The control system reduces impeller pitch to allow the engine higher rpm. Reduced impeller pitch requires a commensurate reduction in nozzle area. Pump head is rising as the square of the rpm. Inlet head is rising as the square of the boat speed. The increasing pump rpm, the reducing pitch, and the higher inlet pressure are all factors, which will result in the control system's reducing the nozzle area to maintain peak pump efficiency. Hence, nozzle area is reduced with increasing rapidity as boat speed increases as a natural consequence of the system operation, until minimum nozzle area is reached at the top design speed of the system. The minimum nozzle area at top speed is also ideal for reducing the system flow rate, hence improving propulsion efficiency at the higher speed.

BEST MODE FOR CARRYING OUT THE INVENTION

Figure 1:
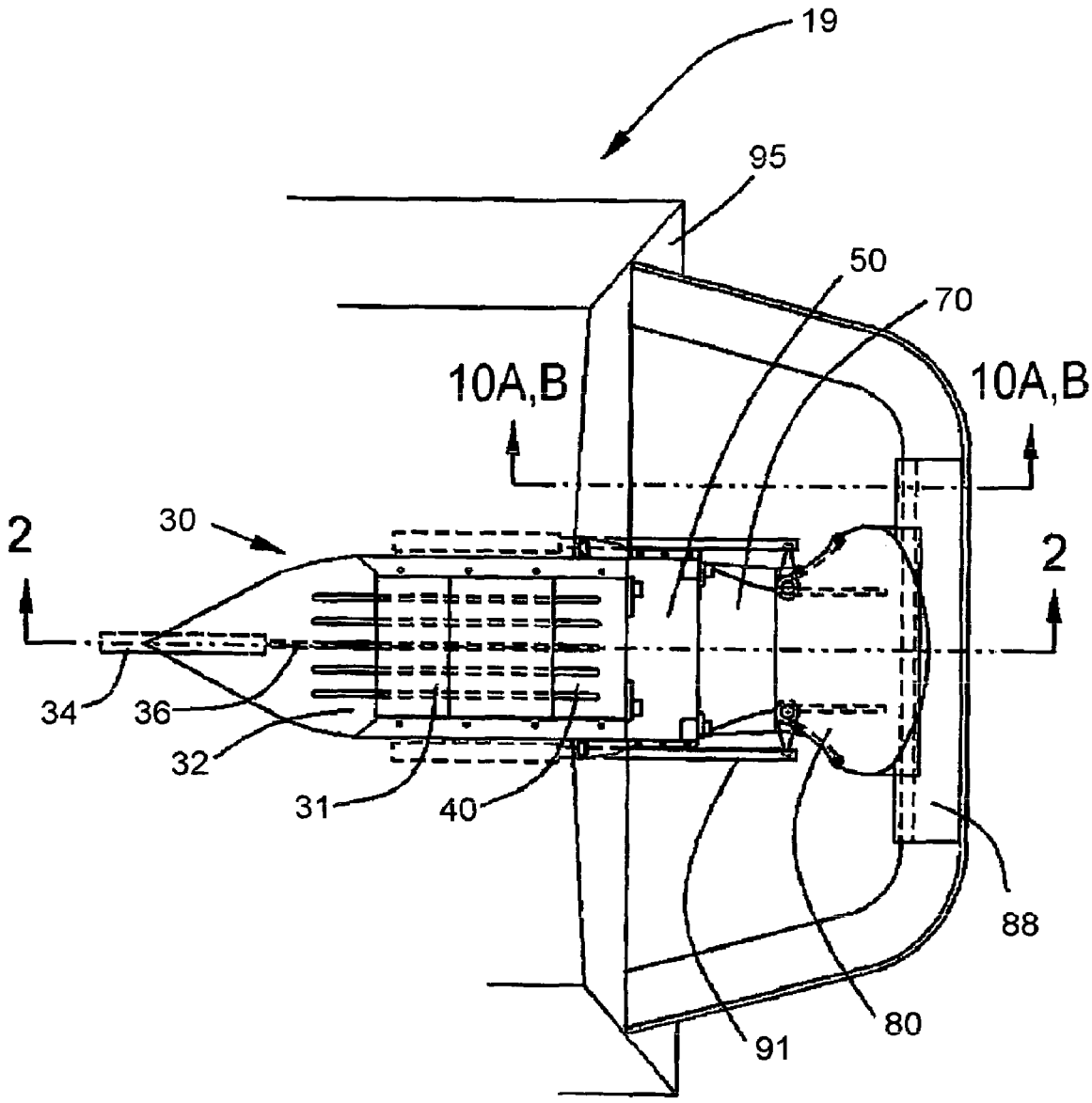
FIG. 1 is a plan view of the bottom of a boat, which incorporates an Improved Marine Jet Propulsion System, showing the hull, inlet duct, pump housing, variable nozzle, and the swim platform.

In the accompanying FIGS. 1-13, there is shown an improved marine jet propulsion system, generally referred to as 20, designed to achieve higher propulsion efficiency, greater maneuverability, and better injury prevention features than currently available marine propulsion systems.

The system 20 includes a variable water inlet duct 30 for admitting water into the system 20, a variable-pitch spherical pump 50 capable of receiving and pumping a relatively large amount of incoming water, and an adjustable, large, variable rectangular discharge steering nozzle 80 capable of forcibly exiting the water pumped by the spherical pump 50 to propel the watercraft 19 through the body of water 29. A microcontroller 140 controls the variable inlet duct 30, the variable pitch spherical pump 50 and the variable discharge steering nozzle 80. By simultaneously controlling the variable inlet duct 30, the variable-pitch spherical pump 50, the large variable rectangular discharge steering nozzle 80, the propulsion efficiency of the system 20 is greatly improved over marine jet propulsion systems of the prior art.

The inlet duct 30 is designed so that hydraulic efficiency of the system 20 is optimally maintained at all watercraft 19 velocities, as described in my US Patents. In this embodiment, the entrance area of the inlet entrance opening 32 is varied by the action of the inlet hydraulic slide cylinder 34 on an adjustable inlet slide 31 to match the velocity of the water in the inlet entrance opening 32 to the velocity of the water passing under the watercraft 19.

Figure 2:
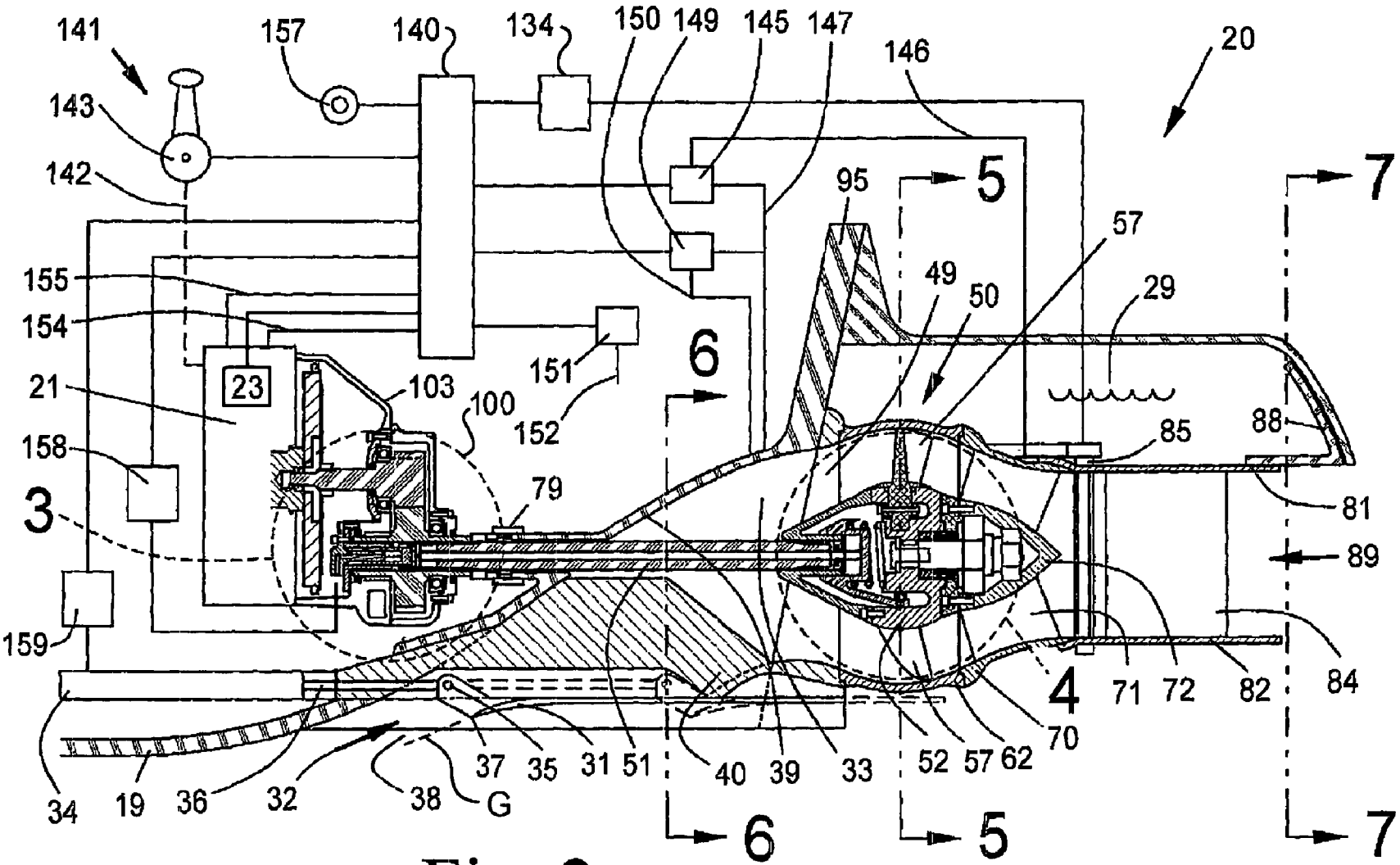
FIG. 2 is a midline vertical section view indicated on FIG. 1, showing the internal details of the improved marine jet propulsion system and the control system schematic.
Figure 4:
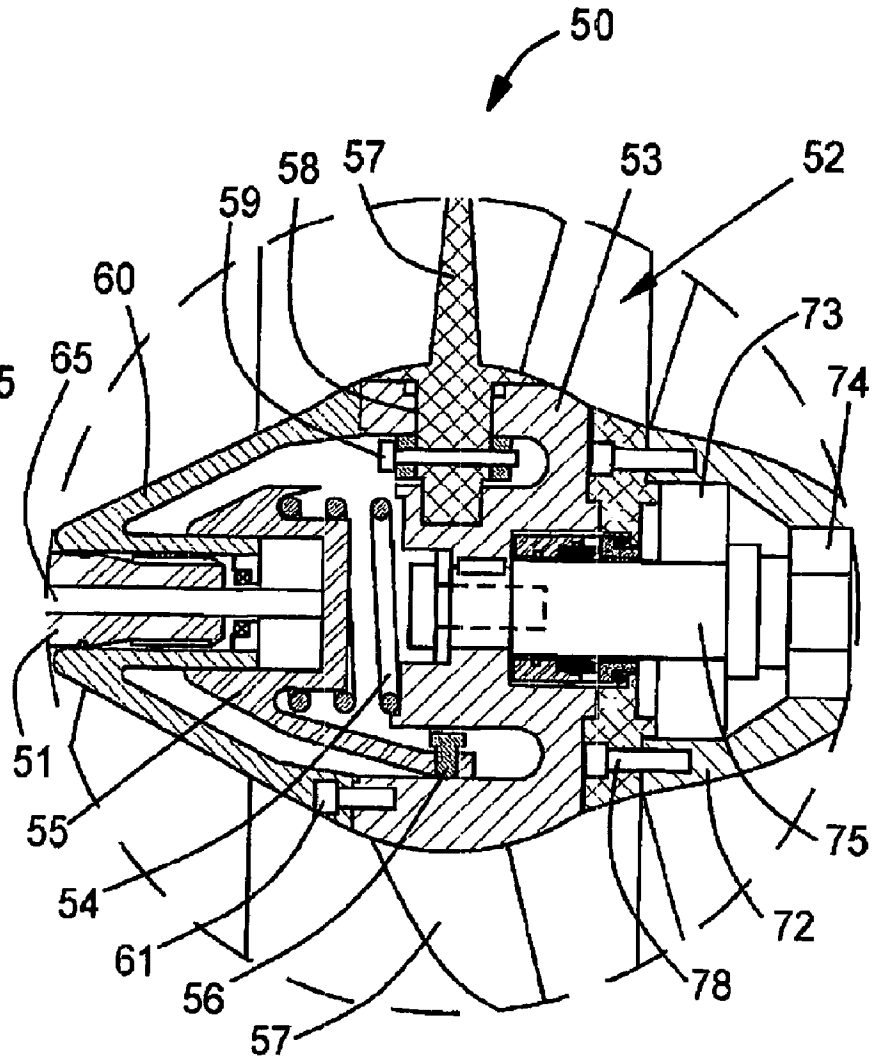
FIG. 4 is an enlarged view of the area indicated on FIG. 2, which shows the details of the impeller hub and vane pitch operating mechanism.
Figure 3:
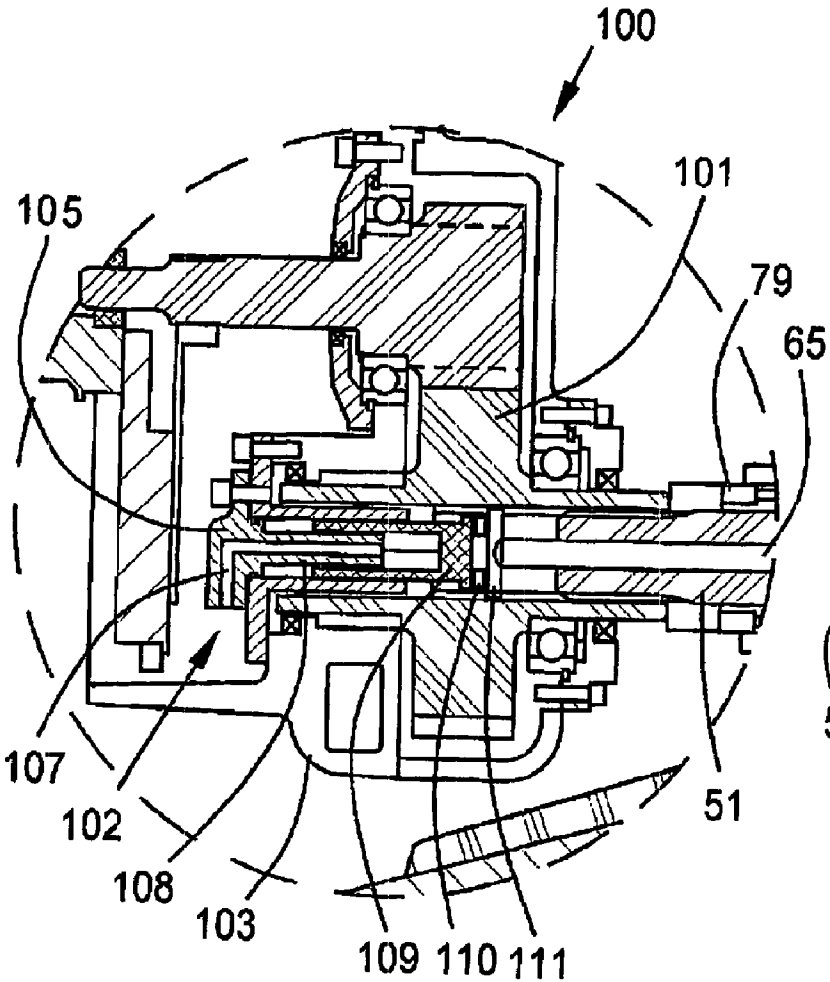
FIG. 3 is an enlarged view of the area indicated on FIG. 2, which shows the details of the hydraulic control piston for the vane pitch.
Figure 5:
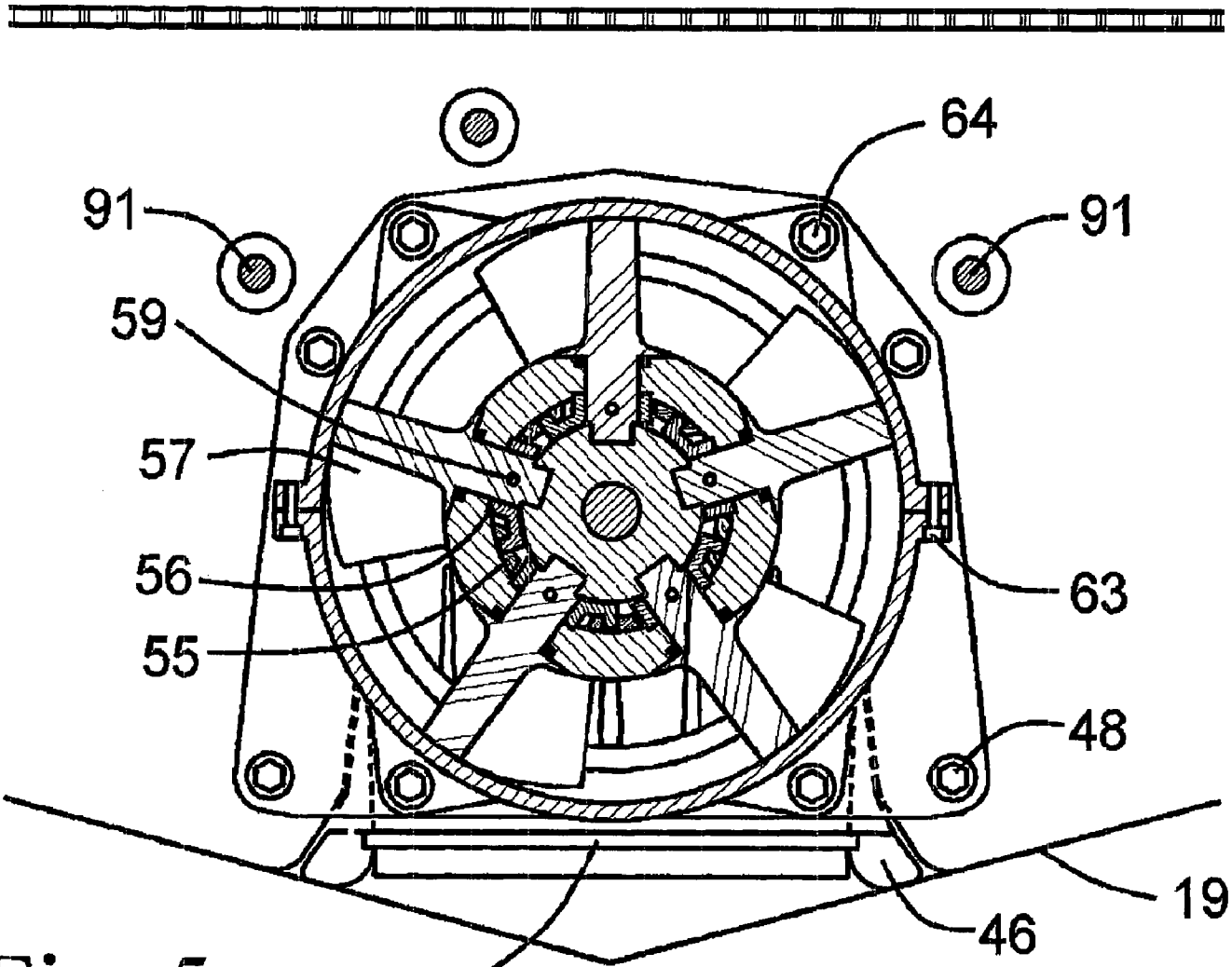
FIG. 5 is a section view indicated on FIG. 2 showing the vanes in the inlet duct and the sliding gate beneath the vanes.

As shown in FIGS. 1-6, the inlet duct 30 includes adjustable inlet slide 31 located over the inlet entrance opening 32 of the hydraulically efficient, elongated inlet tunnel 33 formed or attached to the bottom of the watercraft 19. The inlet hydraulic slide cylinder 34 moves the adjustable inlet slide 31 to vary the effective area of the inlet entrance opening 32. The inlet tunnel 33 is longitudinally aligned on the watercraft 19 with a front inlet entrance opening 32 and a rear exit opening 49. The inlet tunnel 33 gently curves upward inside the watercraft 19 and has a larger cross-sectional area at its exit opening 49 than at its inlet entrance opening 32, when the adjustable inlet slide 31 is in its forward position as shown in FIG. 2. The surrounding surface of the inlet entrance opening 32 of the inlet tunnel 33 is gently curved from tangent to bottom of the watereraft 19 so that turbulence is minimal at the inlet entrance opening 32 of the inlet duct 30.

A grate structure 40 fits in the elongated inlet tunnel 33 and attaches to the watercraft 19 with grate structure fasteners 48, so that the conversion of excess entrance velocity at the inlet entrance opening 32 into pressure at the rear exit opening 49 takes place largely in the rectangular passages or flow channels 41 between grate vanes 42. It is well understood in the art of hydraulic design that dividing the flow into such rectangular flow channels 41 reduces turbulence losses in the water system flow (indicated in FIG. 2 by arrow 32), which are larger than the frictional losses against the vane surfaces. The system 20 moves the adjustable inlet slide 31 by means of the inlet hydraulic slide cylinder 34 to adjust the size of the inlet entrance opening 32 so that the velocity of the incoming water therethrough matches the velocity water under the watercraft 19 in the body of water 29 in which the watercraft 19 moves. By controlling the relative velocity of the incoming water through the inlet entrance opening 32 and by using a hydraulically efficient inlet tunnel 33, which gradually increases in cross-sectional area from its inlet entrance opening 32 to its exit opening 49, the dynamic head of the incoming water may be efficiently recovered at the spherical pump 50.

Figure 6:
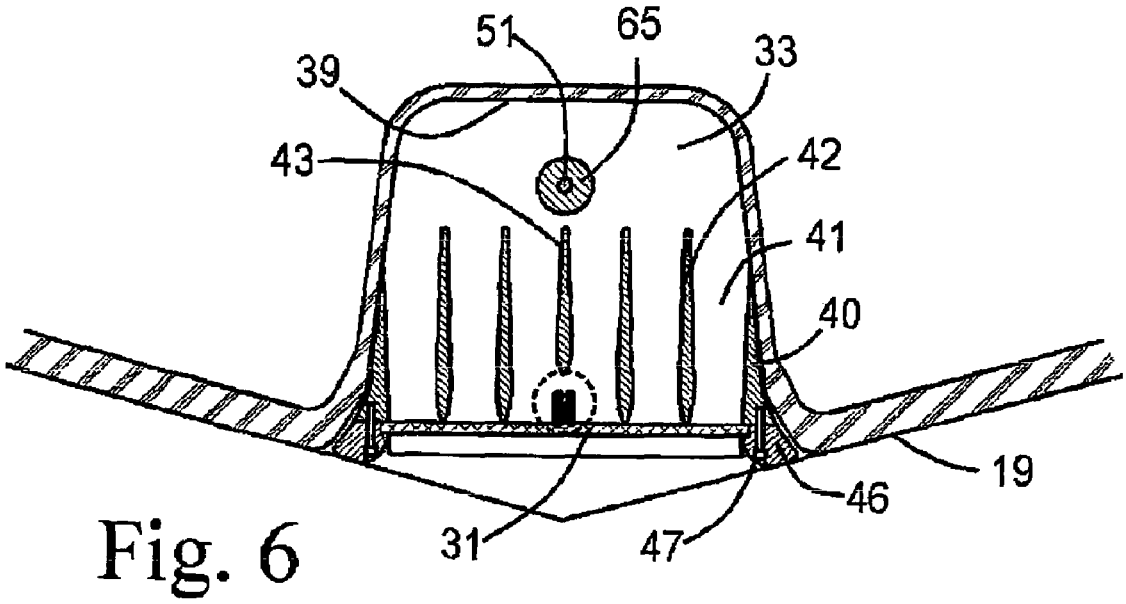
FIG. 6 is the section view indicated on FIG. 2 showing the variable vane operating mechanism of the pump.
Figure 7:
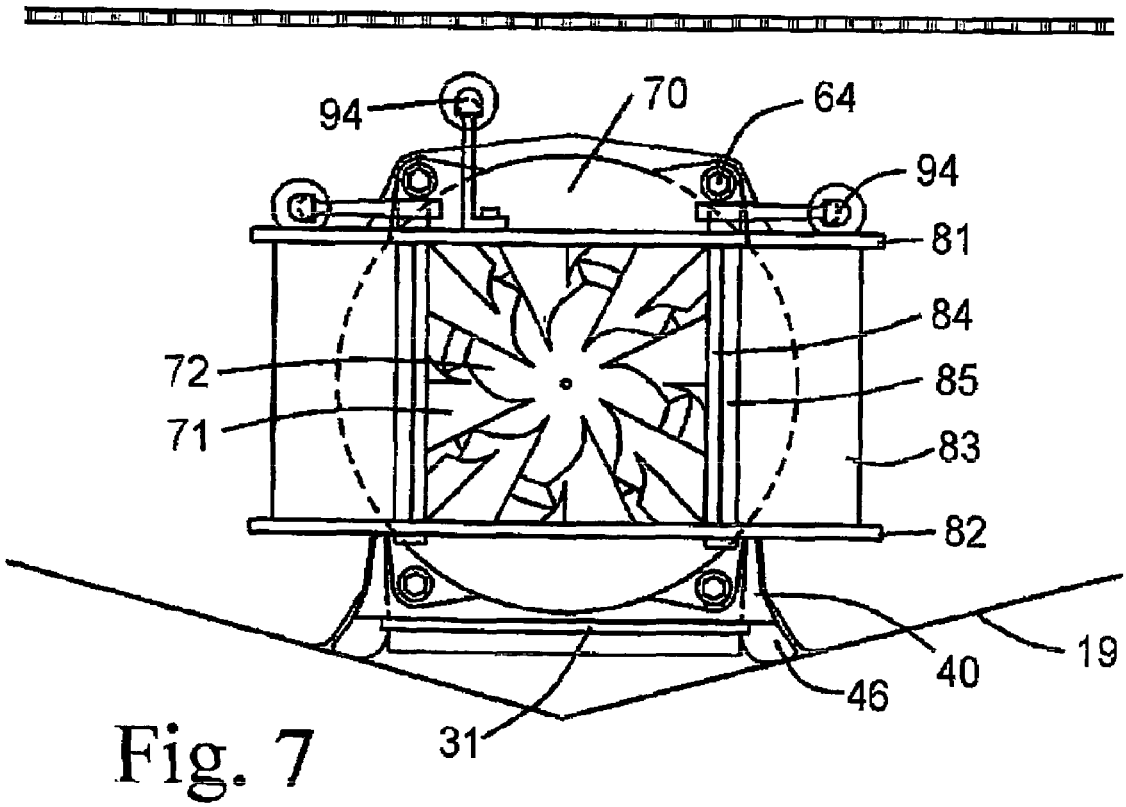
FIG. 7 is a rear section view of the boat indicated on FIG. 2 showing the variable rectangular nozzle under the swim platform.

As shown in FIGS. 1, 2 and 6, the grate structure 4O includes a plurality of spaced apart, longitudinally aligned elongated grate vanes 42. The middle grate vane 43 is vertically truncated to allow passage for the inlet slide cylinder shaft 36 of the inlet hydraulic slide cylinder 34, which passes through the watercraft 19. The inlet slide cylinder shaft 36 is attached to the adjustable inlet slide 31 with clevis pin 35, so that the action of the inlet hydraulic slide cylinder 34 moves the adjustable inlet slide 31 in response to the microcontroller 140. The adjustable inlet slide 31 is held in place by the slide rails 46, which are attached to the grate structure 40 with the slide rail fasteners 47. The leading edge 37 of the adjustable inlet slide 31 bends downward so that the effective entrance angle of the leading edge 37 is approximately parallel to the upper inlet surface 39 of the inlet tunnel 33, so that the velocity of inlet entrance flow (indicated in FIG. 2 by arrow 32), which is parallel to the upper surface 39 will approximately match the entrance angle of the leading edge 37, which is well understood in the art of hydraulic design to provide efficient separation of the inlet flow from the water under the boat.

When the watercraft 19 is stationary or at low speed, water enters the inlet entrance opening 32 via the suction created by the spherical pump 50. During this stage, the adjustable inlet slide 31 is in its rearmost position as shown by the ghost line position G in FIG. 27, so that the inlet entrance opening 32 is wide open and the grate vanes 42 act as diffusers to reduce entrance swirl. As the watercraft's speed increases, water enters the inlet entrance opening 32 by the forward movement of the watercraft 19 through the body of water 29 and by the suction of the spherical pump 50. The microcontroller control system 140 adjusts the position of the adjustable inlet slide 31 through the inlet hydraulic slide cylinder 34 and inlet slide cylinder shaft 36 so that the velocity of the water entering the inlet entrance opening 32 matches the velocity of the water under the watercraft 19. At the top design speed of the system 20, the adjustable inlet slide 31 is in the forward position shown in FIG. 2.

As the velocity of the incoming water at the inlet entrance opening 32 relative to the velocity of the incoming water at the exit opening 49 in the inlet tunnel 33 increases, the microcontroller 140 progressively moves the adjustable inlet slide 31 forward. It can be seen that this has two effects—first, it reduces the effective area of the inlet entrance opening 32 of the inlet tunnel 33; and second, it increases the effective length of the inlet duct 30. It can be seen that the changes both in cross-sectional area and change in flow direction within the inlet tunnel 33 are always gradual, which are design requirements well known in the art for the efficient recovery of pressure head in the turbines and venturi flow meters. It can also be seen that the increasing effective length of the inlet tunnel 33 with decreasing effective area of the inlet entrance opening 32 maintains a nearly constant rate of change in area over the inlet tunnel's range of operation. The total dynamic head of the incoming water can then be efficiently recovered at the spherical pump 50.

Disposed adjacent to the exit opening 49 of the inlet tunnel 33 is the spherical pump 50, which is coupled via a drive shaft 51 and transmission 100 to an engine 21. In the embodiment shown, the spherical pump 50 is contained in a split spherical pump housing 62, which is attached to the grate structure 40 with the fasteners 64. The spherical pump 50 is axially aligned with the inlet duct exit opening 49, so that the splined drive shaft 51 extends forward there from and connects to the transmission 100. In the embodiment shown, the spherical pump 50 includes a spherical impeller 52, which rotates to forcibly deliver the incoming water from the exit opening 49 to the discharge steering nozzle 80 located on the opposite side of the spherical pump 50. In the preferred embodiment, the spherical pump 50 is designed to be used with a 300 horsepower engine so that the mass flow equals approximately 2200 lbs/sec and the pump head is approximately 70 feet at full power with 18-degree discharge angle on the variable pump vanes. The spherical pump 50 uses a 16-inch spherical impeller 52, which matches the size of the diffuser 70, which is disposed over the aft position of the spherical pump 50 to recover the vortex velocity produced by the spherical pump 50 as useful propulsive momentum, as is common in the art of pump design. The stator vanes 71 of the diffuser 70 support the diffuser hub 72, which contains the tapered roller bearings 73 and 74.

Referring to FIGS. 2, 3, 4 and 5: In the assembly of the spherical pump 50, the bearings 73 and 74 are first mounted on the pump shaft 75, which is inserted into the diffuser hub 72. The bearing collar 75 is bolted to the hub 72 to carry the thrust of the bearing 73 and to provide mounting surfaces for the mechanical seal. The spherical impeller hub 53 is bolted to the pump shaft 75. The return spring 54 and the spider 55, engaging the operating arms 56, are held in place by a press, while the vanes are inserted radially through the bearing holes 58 and the operating arms 56. Each vane is rotated to align with the pin holes in the operating arms 56 and the locking pins 59 are inserted to lock the assembly together. When the press is removed, the spider 55 is held in place by the operating arms 56, which restrains the return spring 54. The hub cone 60 is fitted over the spider 55 and drawn up against the impeller hub 53 by the progressive sequential tightening of the impeller hub cone bolts 61. This process compresses the return spring 54 and results in the pump impeller vanes 57 being held in the full pitch position by the return spring 54 against the hub cone 60.

The split spherical pump housing 62 is assembled around the impeller 52 and pinned together circumferentially with the fasteners 63. The diffuser 70 is attached to the pump housing 62 with the fasteners 78. The splined drive shaft 51 is assembled into the internally splined driven gear 101 trapping the water seal 79. Matching the internal spline in the pump hub cone 60 to the splined drive shaft 51, the assembled spherical pump 50 and diffuser 70 slide onto the splined drive shaft 51 and are attached to the grate structure 40 with the fasteners 64. Internal to the splined drive shaft 51 is the pushrod 65, which acts on the spider 55.

A vane adjustment means is connected to the pump impeller 52 for controlling pitch of the pump impeller vanes 57, and, hence, the most efficient flow rate of the spherical pump 50. As shown in FIGS. 2, 3, 4 and 5, the vane adjustment means includes the hydraulic cylinder assembly 102 internal to the splined driven gear 101. The hydraulic cylinder assembly 102 is solidly mounted to the bell housing 103 using the fasteners. The end piece 105 of the hydraulic cylinder assembly 102 incorporates a hydraulic fluid passage 107 and a square post 108, which fits a square hole in the vane actuator piston 109 to prevent the rotation of the vane actuator piston 109. The vane actuator piston 109 acts on the roller thrust bearing 110. On the other side of the roller thrust bearing 110, the bearing plate 111 engages the internal spline in the splined driven gear 101, so that the bearing plate 111 rotates with the splined driven gear 101 and the splined drive shaft 51.

It can be seen that when hydraulic fluid is forcibly introduced through the hydraulic fluid passage 107, the vane actuator piston 109 is driven against the bearing 110, which acts on the bearing plate 111 and the push rod 65, which is driven through the rotating drive shaft 51 to act on the spider 55 to compress the spring 54 in the impeller hub 53 and move the operating arms 56, which reduce the pitch of the pump impeller vanes 57.

Located aft position of the pump's diffuser 70 is the variable rectangular discharge steering nozzle 80. The steering nozzle 80 is formed between a top plate 81 and a bottom plate 82, which are held parallel by their attachment to the two wing walls 83. The nozzle steering vanes 84 have integral nozzle vane shafts 85. The nozzle vane shafts 85 are born by bearing holes in the top plate 81 and bottom plate 82. The nozzle steering vanes 84 are formed so that their top and bottom edges fit closely to the top plate 81 and bottom plate 82, respectively. The axes of the nozzle vane shafts 85 are held perpendicular to the plates 81 and 82, so that the rotation of the nozzle vane shafts 85 results in the movement of the nozzle steering vanes 84 between the plates 81 and 82, while maintaining close fits between the edges of the nozzle steering vanes 84 and the plates 81 and 82. As a result of this geometry, there is formed a rectangular nozzle discharge opening 89 which is bounded by the plates 81 and 82 and the nozzle steering vanes 84.

Figure 8A:
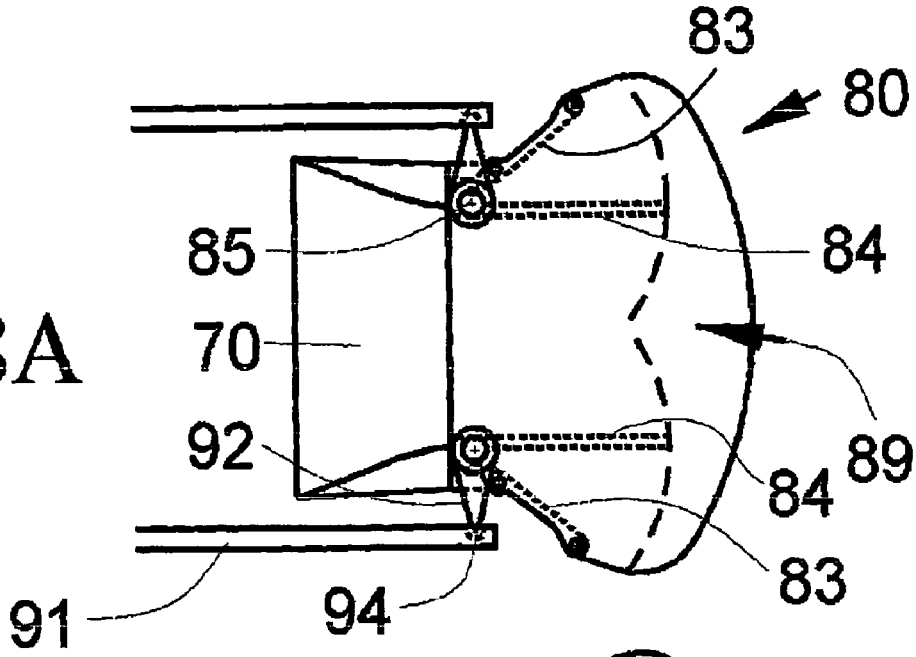
FIGS. 8A, 8B and 8C are schematic overhead views of the variable steering nozzle showing the various vane positions that result from the actions of the hydraulic nozzle controls.
Figure 8B:
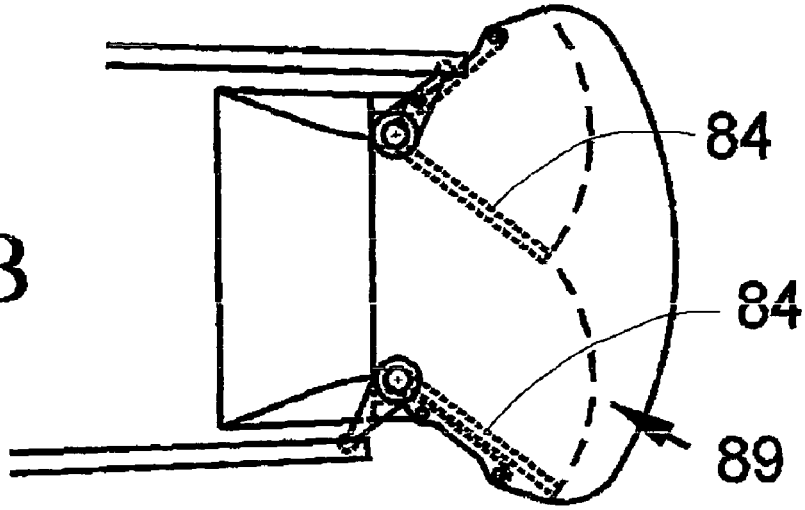
Figure 8C:
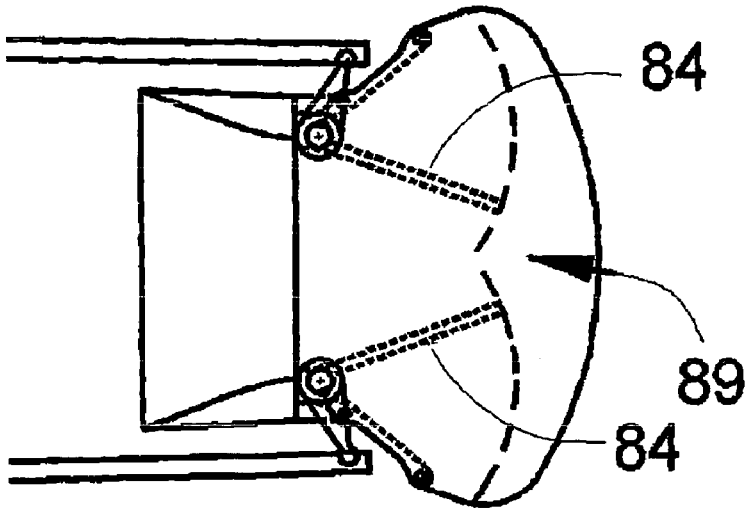

FIGS. 8A, 8b and 8C show top views of the steering nozzle 80, which show how the angle of the nozzle steering vanes 84 can be controlled both to provide steering control and to reduce nozzle area. Each of the nozzle steering vanes 84 is positioned by a hydraulic steering ram 91, which operates on the respective vane operating arm 92. The hydraulic nozzle steering cylinders 93 are mounted inside the transom 95, so that only the steering rams 91 penetrate the transom 95. FIG. 8A shows the nozzle steering vanes 84 in the wide-open straight position. FIG. 8B shows the nozzle steering vanes 84 in the full low speed turn position. FIG. 8C shows the nozzle steering vanes 84 in the high-speed flow reduction position.

Figure 9:
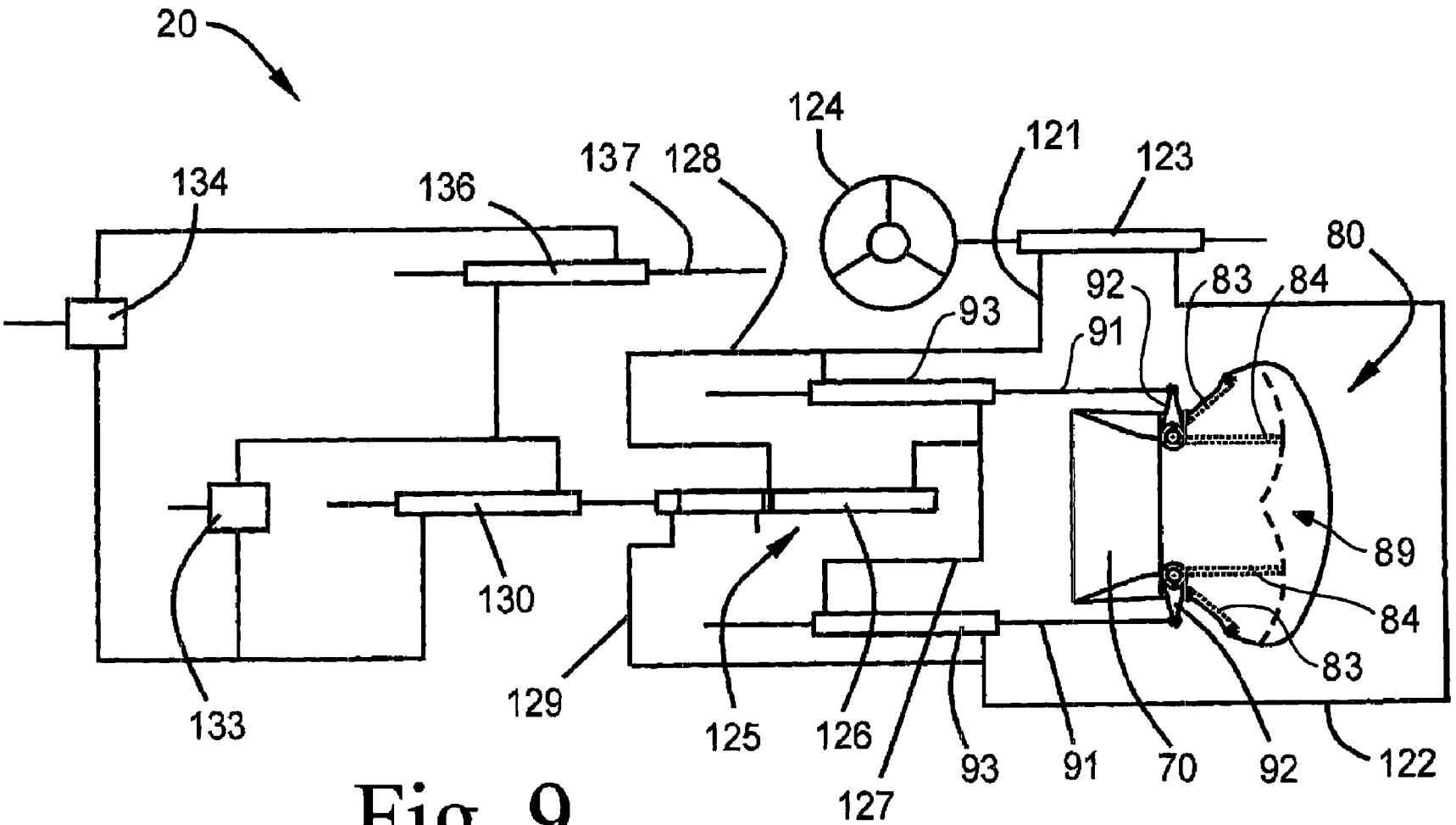
FIG. 9 is a schematic representation of the nozzle hydraulic system, which shows the integration of the steering function, the nozzle area reduction function, and the nozzle pitch function.

FIG. 9 is a schematic of a hydraulic system for controlling the nozzle steering vanes 84 for steering, flow reduction, and nozzle azimuth simultaneously. The azimuth movement is commonly used in planing watercraft as a power trim to adjust the planing angle of the boat, as is well understood in the art. As will be seen in the discussion of FIG. 10 below, the adjustment of the nozzle discharge angle in the vertical plane is also useful for reducing vortexing in the reverse mode.

The double acting hydraulic nozzle steering cylinders 93 penetrate the transom 95 with ball-ended fittings or rubber grommets, as is common in the art, and are connected to the vane operating arms 92 with ball-ended couplings 94, as is common in the art. The hydraulic steering lines 121 and 122 are connected to a hydraulic helm 123, which is driven by the steering wheel 124, as is common in the art. The hydraulic nozzle steering cylinders 93 are series connected for reverse action, so that the hydraulic nozzle steering cylinders 93 move equal distances in opposite directions in response to fluid delivered from the hydraulic helm. This steering action can be seen to result in the common rotation of the nozzle vane shafts 85, until the nozzle steering vanes 84 reach the position shown in FIG. 8B.

The balancing cylinder 125 of FIG. 9 is composed of three hydraulic cylinders in tandem. The driven cylinder 126 is single ended, and is so constructed that the area of the piston of driven cylinder 126 is twice the area of the shaft. The nozzle closing circuit 127 is connected on the closed end of the driven cylinder 126, so that the fluid displacement is proportionate to the area piston of driven cylinder 126. The hydraulic balancing circuit 128 is connected on the shaft side of the piston of driven cylinder 126, so that the fluid displacement in the circuit 128 is equal to half of the displacement of the piston of driven cylinder 126 in the nozzle closing circuit 127 and opposite in direction. The hydraulic balancing circuit connection 129 is made to tandem balancing cylinder 125 in the end connected to driving cylinder 130, so that the displacement in the hydraulic balancing circuit 129 is also equal to half of the displacement of the piston of driven cylinder 126 in the nozzle closing circuit 127 and opposite in direction. It can be seen that the result of this arrangement is that the hydraulic nozzle steering cylinders 93 move in the same direction and by the same amount in response to the movement of the common shaft of the tandem cylinders 126 and 130. It can also be seen that no net fluid displacement occurs in the hydraulic steering lines 121 and 122 from the hydraulic steering helm 123 to the hydraulic nozzle steering cylinders 93. Hence, the displacement of the common shaft of the tandem cylinders 126 and 130 has the effect of increasing and decreasing the angle between the nozzle steering vanes 84, and this movement may cause the nozzle steering vanes 84 to reach the positions shown in FIG. 8C. It should also be noted that the action of the tandem cylinders 126 and 130 is independent of the action of fluid flows from the steering helm 123 at hydraulic steering lines 121 and 122 and may occur simultaneously, so that the system allows simultaneous nozzle area control and steering.

Figure 10B:
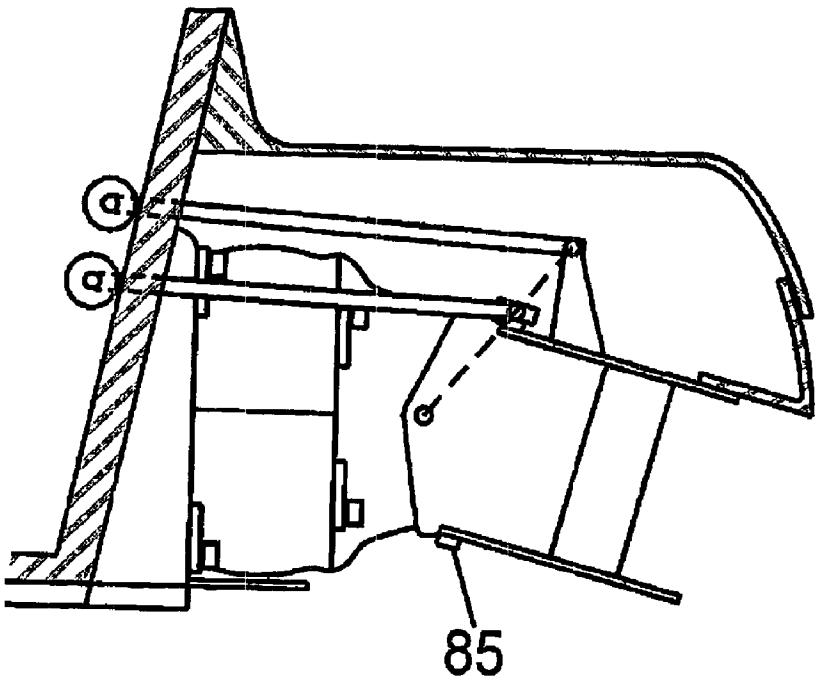
FIGS. 10A and 10B are section views indicated on FIG. 1 showing the power trim adjustment of the propulsion system and the maximum declination, which is used in reverse mode.
Figure 10A:
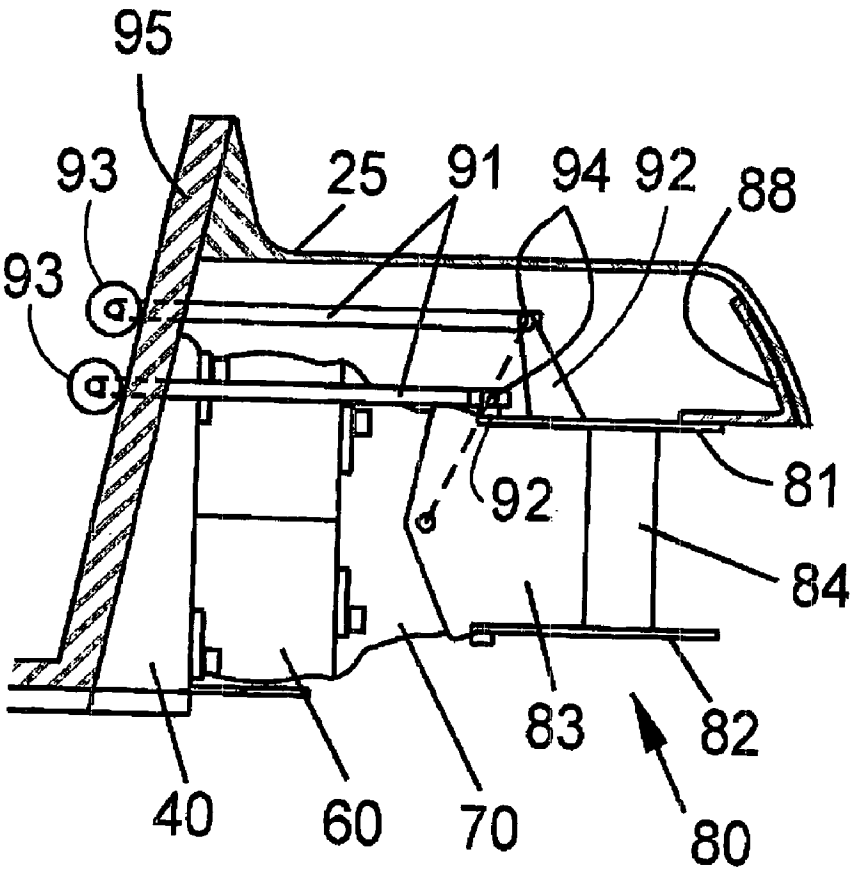

Referring further to FIG. 9, the flow control module 133 controls the displacement of the tandem cylinders 126 and 130. The driving cylinder 130 moves in response to two hydraulic power sources. The flow control valve 134 responds to commands from the microcontroller 140. It is a 4-way valve that controls the motion of the driving cylinder 130, as is common in the art. Through this means the microcontroller 140 acts to adjust the effective nozzle area of the rectangular nozzle discharge opening 89 in order to maintain the efficient operation of the spherical pump 50, as is detailed below. The flow control valve 134, is controlled by the operator to adjust the azimuth of the steering nozzle 80 for power trim, as shown in FIGS. 10A and 10B. The hydraulic circuit from the trim control valve 134 is connected in series with the trim cylinder 136. It can be seen that the effect of this circuit is to displace the trim cylinder 136 and the driving hydraulic cylinder 130 in the same direction. As a result of the motion of the driving cylinder 130, the hydraulic nozzle steering cylinders 93 are also displaced in the same direction. This common motion can be seen to reduce the effect of power trim adjustment on the position of the nozzle steering vanes 84.

FIGS. 10A and 10B are side elevation section views indicated on FIG. 1, showing the action of the optional trim cylinder 136 on the steering nozzle 80. The piston area of the trim cylinder 136 is so chosen relative to the piston area of the hydraulic nozzle steering cylinders 93 and the driving cylinder 130 that the angular displacement of the connection points 94 is approximately equal. As a result, the action of the trim control valve 134 of FIG. 9 is to extend both the trim cylinder ram 137 and the steering cylinder rams 91 by a proportion that minimizes the effect of the trim movement on the steering and nozzle area control functions. The extreme down position of the trim range shown in FIG. 10B is useful in increasing submergence of the steering nozzle 80, which acts as a water inlet in the reverse mode. The nozzle guard 88 serves both to prevent vortex cavitation and to prevent human limbs and other objects from approaching possible pinch points in the steering nozzle 80 mechanisms.

Propulsion system efficiency is the product of four efficiency components: inlet duct 32, pump 50, steering nozzle 80, and engine 21. The steering nozzle 80 has relatively small losses, which can be ignored without significant loss of system efficiency. The recovery efficiency of inlet duct 32 is maximized independently by maintaining the duct entrance velocity to approximate the velocity of the water under the boat 19, as detailed in my US Patents. Pump 50 efficiency is maximized independently by adjusting the nozzle area 89 to maintain the most efficient head, h, on the pump 50 for the current shaft rpm, as detailed in my US Patents. In this disclosure engine 21 efficiency is maintained by incorporating a variable pitch spherical pump 50 in the propulsion system 20 design, which provides continuously variable power demand to track the most efficient power supply of the engine 21. The head nozzle control method and the inlet duct control methods from my US Patents work well in concert with the variable pitch pump 50. The propulsion system 20 simultaneously maximizes all of the four efficiency components: inlet duct 32, pump 50, steering nozzle 80, and engine 21, over a wide range of boat speeds and accelerations. As a result, the design flow of the system 20 can be increased with a smaller efficiency penalty, which allows the use of a higher mass flow rate for better propulsion efficiency, as is well understood in the art. The relevant principles and their interrelation are discussed in more detail below.

FIG. 2 shows the schematic diagram connections of the microcontroller 140. The operator uses the single handle control 141 to control both propulsion direction and the throttle 142 for the engine 21, as is common in recreational boats. The single handle control 141 incorporates a throttle dead band, so that the throttle is set at idle from about 10 degrees forward of the straight-up or neutral position to about 10 degrees back of the neutral position. In the prior art these forward 10 degree and reverse 10 degree travels operate a gear, which shifts the transmission into forward and reverse, respectively, and further travel of the handle out of the throttle dead band increases the engine throttle 142, as is well known in the art. In the present embodiment, the single handle control 141 has the same appearance and function to the operator, but the integral gear shifting mechanism is omitted and replaced with a shaft position encoder 143, which provides the angular position of the single handle control 141 to the microcontroller 140. As is more fully explained in the discussion of FIGS. 12 and 13 below, the microcontroller 140 is programmed to position the vane actuator piston 109 (shown in FIG. 3) through the hydraulic control module 133, so that the vane angle follows the position of the single handle control 141 over the throttle dead band.

Another input to the microcontroller 140 shown in FIG. 2 is the head differential pressure transducer 145, which provides the difference between the pitot tube pressure 146 after the spherical pump 50 and the pitot tube pressure 147 at the inlet of the spherical pump 50. This difference is well understood in the hydraulic art to be the commonly accepted measure of the head, h, on the spherical pump 50.

Another input to the microcontroller 140 shown in FIG. 2 is the flow differential pressure transducer 149, which provides the difference between the inlet pitot tube pressure 147 and the pump inlet static pressure 150. For purposes of the calculations discussed below it is well known that the differential pressure on the transducer 149 is equal to the flow velocity, V, squared divided by twice the acceleration of gravity, g, or: $V^2/2g$ It is also well understood that the volume flow rate, Q, is the product of the velocity, V, and the cross section flow area according to: $Q=VA$, and that mass flow rate, q, is the product of volume flow rate and the density of the fluid, w, so that; $q=Qw$.

Another input to the microcontroller 140 shown in FIG. 2 is the speed pressure transducer 151, which provides the speedometer pitot tube pressure 152 from the boat speedometer pitot tube. For purposes of the calculations discussed below it is well known that this pressure is approximate to the speed of the water craft 19 divided by twice the acceleration of gravity, so the discussion in the previous paragraph also applies here.

Another input to the microcontroller 140 shown in FIG. 2 is the engine tachometer 154. This tachometer input 154 is commonly a pulse train that is read with a timed counter integral to the microcontroller, as is well known in the art.

Another input to the microcontroller 140 shown in FIG. 2 is the engine load signal 155, which is output by the engine combustion microcontroller. This interface is well known in the automotive art.

Another input to the microcontroller 140 shown in FIG. 2 is the operator preference input 157, which is a variable resistance or optical encoder to indicate the operator preference for performance or economy operation.

The microcontroller 140 has several control outputs, through which it controls the movement of the nozzle steering vanes 84, the pump impeller vanes 57, and the adjustable inlet adjustable inlet slide 31. The operation of the flow control valve 134 and flow control module 133 has been discussed in relation to FIG. 9 above. The balancing cylinder 125 of FIG. 9 has internal positional feedback to the microcontroller 140, as is well known in the art. The inlet control module 159, shown in FIG. 2, uses hydraulic power and incorporates positional feedback. The impeller vane hydraulic control module 158 also uses hydraulic power and incorporates positional feedback.

In one embodiment, the program for microcontroller 140 is a PICmicro® Microcontroller, which is available from Microchip Technology. Programs for these devices are developed using the Microchip's C programming environment. This development system is capable of incorporating a wide range of mathematical functions in the control program. The following paragraphs provide background on the functions to be incorporated in the control program.

The Basis of the Control Relationships

The relationships for controlling the inlet duct and nozzle are developed in detail in my said US Patents, and reviewed in the discussion of FIG. 12 below. The technical basis for controlling the pump impeller vane 57 pitch to maintain the engine 21 at its most efficient operation follows.

Figure 11:
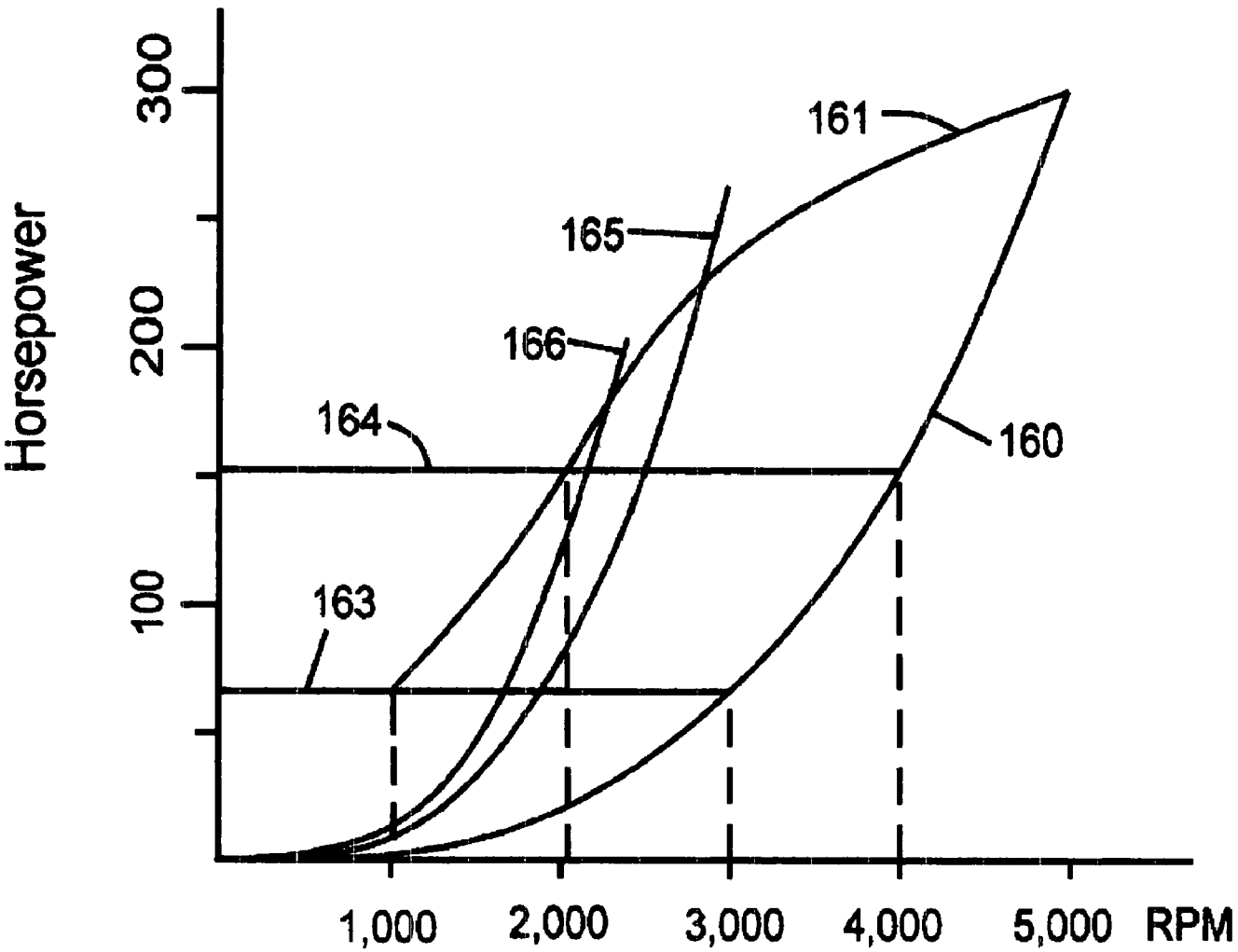
FIG. 11 is a graph on which shaft power is plotted against shaft rpm, showing the relationships between pump power demand and efficient engine power supply.

FIG. 11 is a graph of shaft power versus shaft rpm, showing the relationship between pump shaft power demand and a typical engine's most efficient power supply. In a typical water jet propulsion system design, the gearing between the pump and engine is chosen so that pump power demand curve 160 intersects the engine power supply curve 161 at the highest allowable engine rpm, which is taken to be 5000 rpm in FIG. 11. When the pump is maintained at its most efficient head and flow, the pump power demand curve 160 is approximately a cubic curve as shown in FIG. 11, as is well known in the art of pump design, and particularly in the area of pump affinity relationships. The difference between the most efficient power supply curve 161 and the pump power demand curve 160 is unfortunately greatest in the most frequent operating range, which falls between the horizontal lines 163 and 164. Hence, the engine 21 is operating furthest from its most efficient operating rpm most of the time. When the pump power demand curve 160 represents the variable pitch spherical pump 50 with the pump impeller vanes 57 at about 18 degrees beta-2, as vane pitch is commonly designated in the pump art, the full-pitch pump power demand curve 165 represents the power demand curve of the same spherical pump 50 with the pump impeller vanes 57 set at full pitch of about 40 degrees beta-2. It is well understood in the art of pump design that this range of efficient operation is common to variable pitch propeller pumps. The spherical pump 50 has the additional efficiency advantage of having close fits between the tips of the pump impeller vanes 57 and the housing 62, even at pitches greater than 40 degrees beta-2. It is clear that the full-pitch pump power demand curve 165 much more closely matches the engine's most efficient power supply curve 161 in the most frequent operating range between the horizontal lines 163 and 164. Such reduction of engine rpm is widely used in the automotive power transmission art to increase fuel efficiency and engine life. At the bottom end of operating range on the horizontal line 163, the engine rpm is reduced from about 3,000 to about 2000. At the top end of the operating range along the horizontal line 164, the engine rpm is reduced from about 4,000 to about 2,600 as indicated by full-pitch pump power demand curve 165. There is a continuous range of efficient spherical pump 50 power demand curves between the curves 165 and 160, which result from the continuous variation in pump impeller vane 57 pitch possible in the spherical pump 50. One of these intermediate curves can be seen to be the most efficient for each possible engine rpm between 3,000 and 5,000 in FIG. 11.

The pump power demand curves 160 and 165 and the range of efficient curves in between are based on the assumption that the pump is maintained at its most efficient head and flow for every shaft rpm and for every vane pitch. Following my said US Patents, this function is approximated by a control function based on the pump affinity relationship: head, h, equals an affinity constant multiplied by the square of the pump rpm, N, or h=kN^2. This nozzle control function and method are detailed in my U.S. Pat. No. 5,679,035, which is incorporated here by reference. It is well understood in the art of pump design that the affinity relationship between pump head, h, and shaft rpm holds true for variable-vane pumps over a wide range of vane settings. It is also well understood in the art that the pump affinity constant is only approximate, because the pump efficiency is reduced at higher shaft rpm, N. This efficiency deviation from the affinity relationship generally does not cause significant losses in employment of the nozzle control function, because the pump efficiency does not drop significantly so long as the operating head, h, and flow, Q, are close to the most efficient operating point. However, factoring in an efficiency correction factor based on shaft rpm, N, can increase the accuracy of the head affinity control relationship. In practice, the efficiency reduction in the pump 50 with higher shaft rpm can be largely captured in the head affinity constant, so that the control relationship is still: head, h, equals a constant, k, (corrected for efficiency reduction with increasing rpm) multiplied by the square of the pump shaft rpm, N: h =kN^2. This efficiency correction is also useful in the pump shaft power demand calculation, which is discussed below.

The curve 166 in FIG. 11 represents the power demand curve that can be achieved at somewhat reduced pump efficiency by either further increasing vane pitch or by reducing the nozzle area below that required to maintain the pump at its most efficient operating head, h, and flow, Q. In the preferred embodiment this occurs at low watercraft speeds and low engine rpm, N. For example, the steering nozzle 80 of the preferred embodiment is designed for a rectangular nozzle discharge opening area 89 of 10 inch by 10 inch, which is sufficient to maintain the pump 50 at its most efficient operating point on the full-pitch pump power demand power curve 165 at a watercraft speed of 20 mph, where the inlet duct 30 is recovering about 12 feet of total dynamic head at the pump inlet. However, at zero watercraft speed, and in the absence of the 12 feet of recovered head at the nozzle in addition to the pump head, the maximum nozzle area restricts full-pitch pump flow. Hence, pump head and shaft power demand are increased as is well understood in the pump art. This results in a zero-watercraft-speed, full-pitch power demand curve 166. The curve 166 can be shifted down and to the right by reducing the impeller pitch, which reduces the efficient flow and the corresponding efficient nozzle area to approach the maximum effective nozzle area of the variable rectangular steering nozzle 80. Hence reducing the pitch of the pump impeller vanes 57 reduces the pump shaft power demand in this range, just as it does between the curves 166 and 165. The control area between the curves 166 and 165 is used to get more thrust at low engine rpm at low boat speeds.

Figure 12:
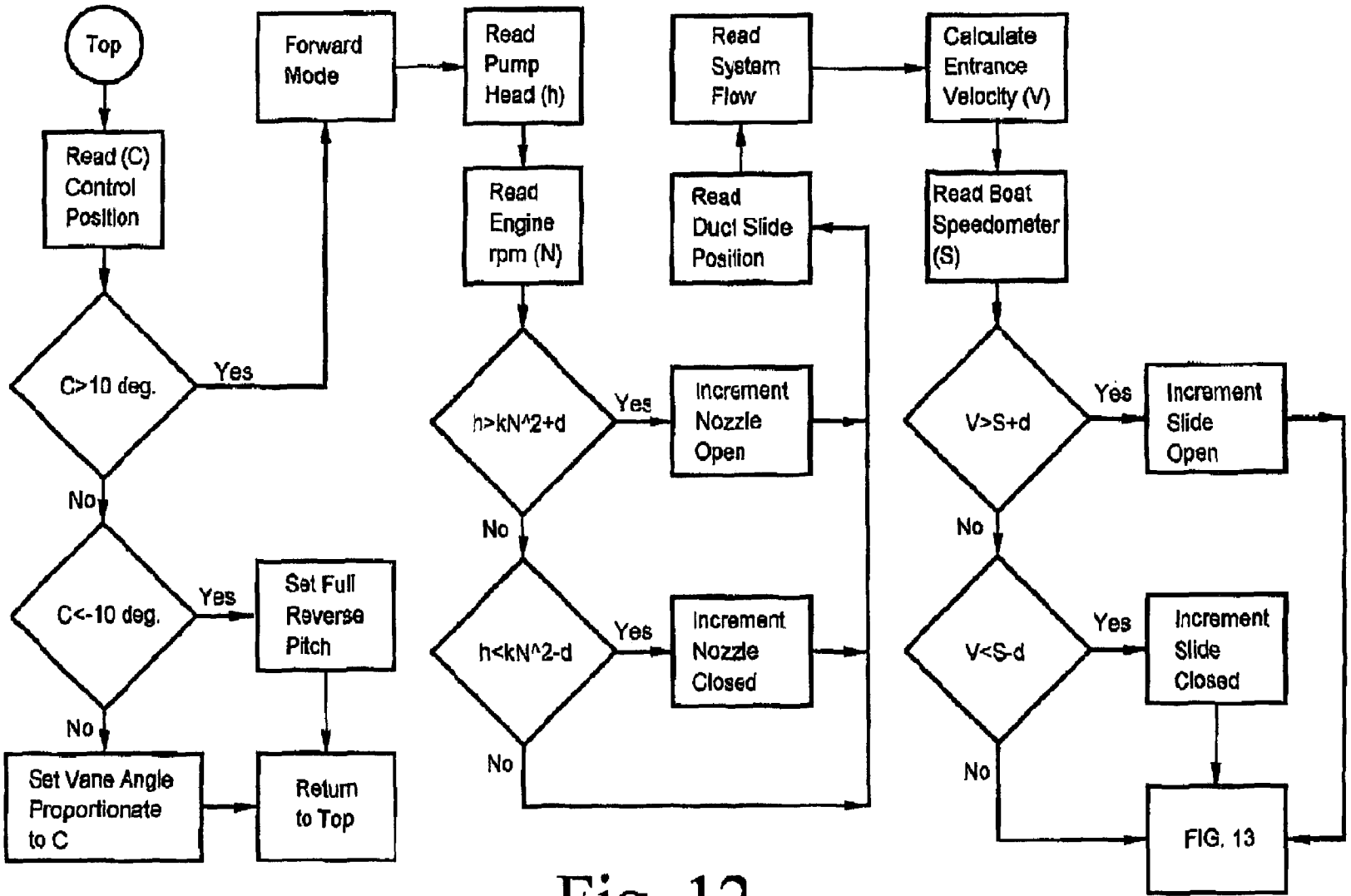
FIG. 12 is a flow chart for the microcontroller program used to control the variable pump vane pitch, the variable nozzle area and the variable inlet entrance area in all embodiments of the invention.

FIGS. 12, 13A, 13B, and 13C are flow diagrams for the microcontroller 140 program. The "d" values in FIGS. 12 and 13 are control dead band factors to prevent hunting, as is common in the art. These are discussed in the Operation of the Invention below.

Operation

Figure 13:
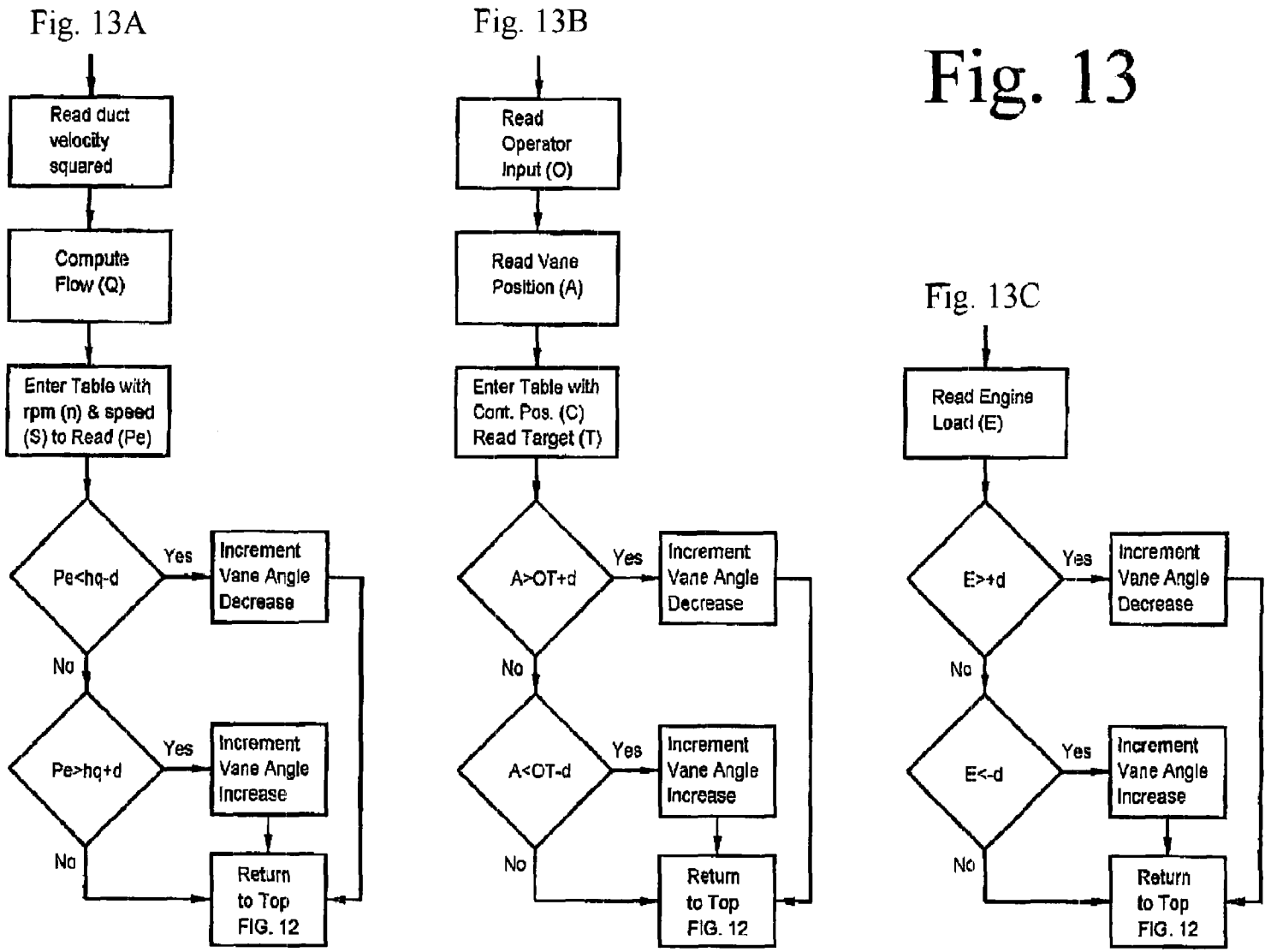
FIGS. 13A, 13B and 13C are flow charts for three alternative microcontroller programs used to control the variable impeller vane angle for efficient engine operation in the forward mode of operation.

The operation of the invention is controlled by the microcontroller 140 using the control program diagrammed in FIGS. 12 and 13. The physical components are shown in FIG. 2. The control loop of FIG. 12 begins with reading the control position C of the shaft encoder 143 on the single handle control 141. If C is in the throttle dead band range, the microcontroller 140 increments the vane impeller vane hydraulic control module 158 to set the pitch of the pump impeller vanes 57 is set to follow C. This has the effect of giving the operator direct control over the forward or reverse flow through the spherical pump 50. The concentric spherical surfaces of the split spherical pump housing 62, the pump impeller vanes 57 and the spherical surface of impeller hub 53 allow the pump impeller vanes 57 to rotate through 90 degrees or more, while maintaining close fits between the pump impeller vanes 57 and both housing 62 and the hub 53. In the preferred embodiment, the impeller vanes rotate to about plus 40 degrees beta-2 for full forward pitch and through zero to minus 20 degrees beta-2 for full reverse pitch. The impeller vane hydraulic control module 158 positions the vane actuator piston 109 (FIG. 3) by controlling the flow of fluid through the hydraulic fluid passage 107. The vane actuator piston 109 acts through the roller thrust bearing 110, the bearing plate 111, the pushrod 65, and the spider 55 to move the operating arms 56, which rotate the pump impeller vanes 57. If C is out of the dead band in reverse, the microcontroller 140 holds full reverse pitch on the pump impeller vanes 57.

If C is greater than idle in the Forward Mode, the program of FIG. 12 branches to adjust the nozzle according to the pump head affinity relationship. The program of FIG. 12 then adjusts the adjustable inlet slide 31 to match entrance velocity to boat speed, and passes control to 13A, 13B, or 13C for setting the pitch of the pump impeller vanes 57.

When the operator moves the single handle control 141 out of the dead band range in the forward direction, the microcontroller program branches to the "Forward Mode" as shown in FIG. 12. In accordance with the discussion of FIG. 12 above, the control program adjusts the nozzle steering vanes 84 between the positions shown in FIGS. 8A and 8C to maintain the most efficient head on the spherical pump 50, according to the pump affinity relationship h=kN^2. This action maintains the spherical pump 50 at its most efficient head for the current shaft rpm. As also shown in FIG. 12, the control program sets the adjustable inlet slide 31 to match the velocity of the inlet entrance 32 flow, Q, to the velocity of the water under the boat. This maintains the most efficient possible recovery of total dynamic head at the inlet of the spherical pump 50.

Control is then passed to one of three methods to match the shaft power demand of the spherical pump 50 to the most efficient power supplied by the engine 21. FIG. 13A sets the pitch of the pump impeller vanes 57 based on pump shaft power demand calculated from measured head and flow on the spherical pump 50. Alternatively, FIG. 13B sets the pitch of the pump impeller vanes 57 based on throttle position as measured by the shaft position encoder 143 on the single handle control 141. Alternatively, FIG. 13C sets the pitch of the pump impeller vanes 57 based on feedback from the combustion control computer 23 on the engine 21. It will be appreciated by those skilled in the art that each of these alternative methods accomplishes the same function: they all adjust the pitch on the pump impeller vanes 57, so that the shaft power demand of the spherical pump 50 approximates the most efficient power supplied by the engine 21 at its current rpm.

This program of FIG. 12 has the following consequences. When the handle 141 is at the forward end of the dead band range, the pump impeller vanes 57 are at full forward pitch, which provides maximum forward thrust. When the handle 141 is in the middle of the dead band range, the pump impeller vane 57 pitch is about zero, which provides no pumping action and therefore a true neutral. When the handle 141 is at the back end of the dead band range, the vane pitch is in the maximum negative position, which provides reverse thrust and back flushing of trash. As the handle moves out of the dead band range in either direction, it increases the engine throttle 142, which increases thrust, as is common with single handle controls on recreational boats. From this it is clear that the action of the propulsion system 20 in response to the position of the control handle 141 is identical to the action of propulsion systems of the prior art.

In the "Forward Mode" of FIG. 12, and referring to FIGS. 2, 9 and 10A, the microcontroller 140 reads the head differential pressure transducer 145 to input the pump head, h, and the engine tachometer input 154 to input engine rpm N. If the measured head is higher than the pump affinity value kN^2 plus a small dead band factor, d, to prevent hunting, the microcontroller 140 uses the flow control module 133, which positions the driving cylinder 130 and consequently the driven cylinder 126, which forces fluid into the hydraulic balancing circuits 128 and 129, while removing an equal amount of fluid from the hydraulic nozzle closing circuit 127. Following the explanation of FIG. 9 above, this results in a balanced fluid flow to the hydraulic nozzle steering cylinders 93, so that the steering rams 91 are equally retracted, acting through ball-ended couplings 94 on the nozzle vane operating arms 92 to increase the distance between the nozzle steering vanes 84, thus increasing the effective nozzle discharge opening area 89. This has the effect of increasing the water flow 44 and consequently reducing the head h on the spherical pump 50. If the measured head, h, is lower than the pump affinity value kN^2 minus a small dead band factor, d, to prevent hunting, the microcontroller 140 uses the flow control module 133, which positions the driving cylinder 130 and consequently the driven cylinder 126, which removes fluid from the hydraulic balancing circuits 128 and 129, while it forces an equal amount of fluid from the hydraulic nozzle closing circuit 127. Following the explanation of FIG. 9 above, this results in a balanced fluid flow to the hydraulic nozzle steering cylinders 93, so that the steering rams 91 are equally extended, acting through ball-ended couplings 94 on the nozzle vane operating arms 92 to reduce the distance between the nozzle steering vanes 84, thus reducing the effective nozzle discharge opening area 89. This has the effect of reducing the water system flow 44 and consequently increasing the head, h, on the spherical pump 50. If the head, h, is within the dead band range, no nozzle control action is taken.

The next sequence in the control loop of FIG. 12 is setting the adjustable inlet slide 31. Referring to FIG. 2, the microcontroller 140 reads the position of the inlet hydraulic slide cylinder 34 from the inlet control module 159 and computes the effective inlet entrance area. It reads the flow differential pressure transducer 149 and computes the water system flow Q (indicated in FIG. 2 by arrow 32) as in the description of the flow differential pressure input on the transducer 149 above. The microcontroller 140 then computes the entrance velocity through the inlet entrance opening from V=water system flow, Q, divided by the effective inlet entrance area, A. The microcontroller 140 reads the boat speed pressure transducer 151 and compares watercraft speed S. If V>S+d, the microcontroller 140 outputs to the inlet control module 159, which actuates the inlet hydraulic slide cylinder 34 to move the adjustable inlet slide 31 back, which increases the effective entrance area and reduces the entrance velocity V. If V<S−d, the microcontroller 140 outputs to the inlet control module 159, which actuates the inlet hydraulic slide cylinder 34 to move the adjustable inlet slide 31 forward, which reduces the effective entrance area and increases the entrance velocity V. This control function meets the requirement of my said US Patents that inlet duct efficiency requires that the flow velocity through the inlet entrance approximate the velocity of the water under the hull, which is indicated by the boat speedometer 152. From the discussion above, it is clear that the microcontroller 140 can also be programmed to calculate the water system flow, Q, from positional feedback from the impeller vane control module 158 on the angle of the pump impeller vanes 57, which would allow the elimination of the flow differential pressure transducer 149 input in the control loop.

At the end of FIG. 12 the microcontroller program control passes to FIG. 13A, 13B, or 13C to match the spherical pump 50 power demand to the power most efficiently supplied by the engine 21 by varying the pitch of the pump impeller vanes 57.

The control scheme in FIG. 13A first computes the hydraulic power produced by the spherical pump 50, which is the product of pump head, h, and system mass flow rate, q. The pump shaft power demand is the hydraulic power divided by the hydraulic efficiency, e, so that the control equation for efficient engine operation may be written: P=hq/e or Pe=hq. The latter formulation is convenient, because both the efficient engine power, P, and the hydraulic efficiency, e, are dependent on shaft turn rate in rpm, N, Hence a table of control equation Pe values, which is entered with the shaft turn rate, rpm N, and the boat speed, S, can be highly accurate. In the preferred embodiment, the boat speed factor, S, is only useful for boat speeds of less than 20 mph, where the power demand curve falls between the curves 166 and 165 of FIG. 11. The pump head, h, is constantly available from the nozzle control loop of FIG. 12. The system mass flow rate, q, calculation is discussed above in the description of the flow differential pressure transducer 149 input. It will be apparent to one skilled in the control systems art that other methods of inputting the mass flow rate could be used, including mechanical, acoustic and optical flow sensing devices. The microcontroller 140 sets the pump impeller vane 57 pitch by outputting to the impeller vane control module 158. Control passes back to the top of FIG. 12.

Alternatively, in FIG. 13B the control loop uses a table of vane pitch targets, T, which is entered with control position C. The vane pitch targets values, T, include adjustments for pump efficiency variations and other factors based on test results. The control position, C, is a measure of the engine throttle 142 setting, which has an associated most efficient operating shaft turn rate in rpm, N. This shaft turn rate in rpm is implicitly included in the table of values for vane pitch targets, T, which is entered with control position, C. It will be obvious to those skilled in the art that the watercraft speed, S, may be incorporated in the table of values for vane pitch targets, T, to improve performance, as discussed above. The microcontroller program then sets the vane pitch to the vane pitch target, T. This method presumes that the engine is operating at peak performance. The operator preference input 157 may be used to reduce the shaft power demand when the engine is out of tune or laboring. It may also be used to choose between low-speed performance and fuel economy, as is common in automotive power transmission. This preference factor is "0" in the control equations of FIG. 13B. This operation may be similar to trimming the propeller pitch in an airplane. After the pump impeller vane 57 pitch is adjusted, control passes back to the top of FIG. 12. This method requires no flow input to and no power calculations by the microcontroller 140. It is particularly useful for legacy diesel engines at sea level. The microcontroller 140 sets the pump impeller vane 57 pitch by outputting to the impeller vane control module 158, as described above. Control passes back to the top of FIG. 12.

FIG. 13C uses the output from the combustion microcontroller on the engine 21 as the best measure of the power most efficiently supplied by the engine at the current shaft turn rate in rpm, N. This control method is well understood in the automotive field of art, as it is widely used to determine shift points in automatic transmission controllers and to control continuously variable transmissions. In effect, the microcontroller 140 is programmed to act as a slave to the engine 21 combustion microcontroller, which dynamically determines the most efficient power demand for the motor based on a complex set of environmental and combustion variables, as is well understood in the art. In each control cycle the microcontroller 140 incrementally increases, decreases, or leaves unchanged the impeller pitch, based solely on the input from the combustion control computer 23. This method requires no pump head input, no rpm input, no system flow input and no positional feedback for controlling the impeller vane pitch to match shaft power demand to the most efficient power supplied by the motor. After the pump impeller vane 57 pitch is adjusted, control passes back to the top of FIG. 12.

Note that the method of FIG. 13C requires neither flow measurement nor vane positional feedback, because it incorporates control feedback from the engine combustion control computer. When the direct flow measurement means is not required in the "Increment Vane Angle" control sequence, as in FIG. 13C or when flow is estimated by pump impeller vane 57 pitch, it can be compared with the positional feedback from the pump impeller vane 57 angle to monitor the operating efficiency of the marine jet propulsion system 20. If the calculated flow is lower than that indicated by the pump impeller vane 57 position, the likely cause is debris on the inlet grate vanes 42, pump impeller vanes 57, and/or stator vanes 71. The microcontroller 140 may be programmed to alert the operator by an alarm means, such as a light or a horn.

With any of these combinations, the microcontroller 140 is programmed to adjust the pitch of the pump impeller vanes 57 through the hydraulic impeller vane control module 158, so that the spherical pump 50 shaft power demand is made to approximate the most efficient power supplied by the engine 21 at the current shaft turn rate in rpm, N.

The functional advantages of this program of operation are described more fully below.

When the operator switches the ignition on, the microcontroller 140 outputs to the vane control module 158 to set the pump impeller vane 57 pitch to the position indicated by the shaft position encoder 143 on the single handle control 141, which is generally zero pitch for neutral pump flow. The operator then starts the engine 21, which idles at for example about 1,000 rpm. In response to the movement of the single handle control 141 in an approximately +/−10-degree dead band range, the microcontroller 140 adjusts the pump impeller vane 57 angle to continuously vary the forward, neutral, and reverse thrust of the marine jet propulsion system 20, as detailed in FIG. 12 and the associated discussion above. Moving the handle through the straight up position results in a scissoring action between the pump impeller vanes 57, which cleans debris off the leading edges of the vanes. Moving the handle further back results in reverse pitch and in reversing the pump flow, which back flushes the system for trash removal. Such reverse pump flow also produces an effective reverse thrust. Moving the handle 141 back further increases engine rpm and consequently the magnitude of the reverse thrust, just as is common in propeller driven boats.

This operation provides smooth, quick shifting from forward to reverse thrust for low speed maneuvering, because there is no change of shaft direction in transitioning from forward to reverse or from reverse to forward. The swim platform and power trim function, which are both popular on recreational boats of the prior art, may be used to reduce vortex formation and cavitation in the reverse thrust mode, as shown in FIGS. 10A and 10B. The operator independently controls power trim, just as in stem-drive and outboard propulsion systems of the prior art.

The steering wheel controls the action of the nozzle steering vanes 84 through the range of motion shown in FIGS. 8A and 8B through the hydraulic helm and hydraulic circuits shown in FIG. 9 and described above. Turning the wheel 124 of FIG. 9 to the right results in the left position of the nozzle steering vanes 84 in FIG. 8B. The resulting directional change of momentum of the system flow creates a reaction steering force to the right along the transom 95 (shown in FIG. 1), so that when the wheel is turned to the left as in FIG. 8B, the transom 95 is driven to the right. The reaction force resulting from reverse system flow is in the same direction as with forward flow, so that the transom 95 always moves to the right when the wheel 124 is turned to the left. Such reaction forces are well understood in the hydraulic art.

In the forward thrust mode of operation, the variable steering nozzle 80 is controlled to maintain the most efficient head on the variable pitch spherical impeller pump 50 for the current shaft rpm, as is described in my the U.S. Pat. No. 5,679,035 and as further described above. It is well understood in the art that efficiency is fairly constant over a broad range of impeller pitch. The resulting flow through the pump 50 well understood to be a function of the impeller pitch. At low cruising speeds, the power demanded to propel the boat 19 at constant speed is low. To match the power demanded by the pump 50 to the most efficient rpm of the engine 21, the microcontroller 140 sets the pump impeller pitch near maximum, which is the state in which it is passed from the low speed maneuvering mode to the forward mode. To maintain the pump 50 close to its most efficient operating conditions, the microcontroller 140 opens the variable steering nozzle 80 to maximum. In addition to maintaining engine efficiency, this control strategy has the fortunate consequence of providing maximum flow at low speeds for maximum propulsion efficiency. The flow through the maximum nozzle opening also occurs at the lowest possible velocity. Thus, motor efficiency, pump efficiency, and flow rate efficiency are all close to optimum, and wake turbulence is minimized.

When the system 20 is under full acceleration, as in pulling up a water skier, the microcontroller 140 will reduce the pitch on the pump impeller vanes 57 to match the pump's shaft power demand to the engine's 21 most efficient power supply at the instantaneous shaft rpm. The control system will also reduce the nozzle discharge opening area 89 to maintain the most efficient head on the pump 50 for its current rpm.

When the boat reaches steady wakeboarding speed in the approximate range of 15 to 20 mph, the pump impeller vanes 57 are close to full pitch to reduce the engine rpm to the most efficient operating point along the line 163 of FIG. 11. The variable steering nozzle 80 is close to being fully open to maintain the most efficient pump head at the relatively low shaft rpm. A further advantage is that the variable inlet duct opening is near maximum due to the high flow, which results in no losses from the conversion of inlet entrance velocity to pressure at the pump inlet. This also again has the fortunate consequence of providing close to maximum water system flow, Q, at this relatively low boat speed for maximum propulsion efficiency, which also results in minimum nozzle velocity through the large nozzle effective nozzle discharge opening area 89 and consequently in minimum wake turbulence. The system 20 rpm is further reduced relative to systems of the prior art by this higher propulsion efficiency, which requires less shaft power and consequently lower shaft rpm to maintain the boat speed. Thus, engine 21 efficiency, inlet duct 30 efficiency, spherical pump 50 efficiency, and inlet entrance opening area 32 flow rate efficiency are all close to optimum, and wake turbulence is minimized.

When the boat reaches steady water skiing speed at approximately 30 mph, the recovery of pressure in the inlet duct 30 has increased, so the microcontroller 140 has made a slight reduction in effective nozzle discharge opening area 89 to maintain the most efficient system flow rate, Q, through inlet entrance opening 32 and head, h, on the spherical pump 50. The power required to maintain this higher boat speed is also higher, so the engine 21 must operate at a higher rpm to supply the necessary power. The most efficient spherical pump 50 head rises as the square of the shaft turn rate in rpm, N. Higher engine 21 rpm causes the microcontroller 140 to reduce the pitch on the pump impeller vanes 57, which reduces the most efficient system flow rate, Q, through inlet entrance opening 32. The nozzle discharge opening area 89 head-affinity control function implicitly accounts for higher inlet head at this boat speed, higher spherical pump 50 head at the higher shaft rpm, and the reduced system flow rate, Q, through inlet entrance opening 32 resulting from reduced pitch on the pump impeller vanes 57. As a result of all these factors, the nozzle discharge opening area 89 is reduced and the nozzle velocity relative to the boat velocity is increased. However, the nozzle velocity relative to the water 29 surface is reduced by the increased boat speed, so that the velocity of the jet relative to the water surface has only slightly increased. Wake turbulence is thereby only slightly increased, and the use of longer towropes at this higher boat speed makes wake turbulence less critical, since it has more time to dissipate before the skier reaches it.

Further increases in boat speed demand increased engine 21 power, which the engine 21 can only supply at higher rpm. The microcontroller 140 reduces the pitch on the pump impeller vanes 57 to maintain efficient engine 21 operation at the higher rpm. Reduced pitch on the pump impeller vanes 57 requires a commensurate reduction in nozzle discharge opening area 89. Spherical pump 50 head is rising as the square of the engine 21 rpm. Inlet 30 head is rising as the square of the boat speed. The increasing spherical pump 50 rpm, the reducing pump impeller vane 57 pitch, and the higher inlet 30 pressure are all factors, which will result in the microcontroller 140 reducing the nozzle discharge opening area 89 to maintain peak spherical pump 50 efficiency. Hence, nozzle discharge opening area 89 is reduced with increasing rapidity as boat speed increases as a natural consequence of the microcontroller 140 operation, until minimum nozzle discharge opening area 89 is reached at the top design speed of the system 20. The minimum nozzle discharge opening area 89 at top speed is also ideal for reducing the system flow rate 32, hence improving propulsion efficiency at the higher speed.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

The invention claimed is:

1. An improved water jet propulsion apparatus for a jet propelled watercraft, the water jet propulsion apparatus comprising:

a) a variable-pitch propeller water pump structured for operating as a continuously variable power transmission for a motor external to the pump, the pump comprising a plurality of vanes and a mechanism structured for adjusting a pitch on the vanes in such manner that water flow and pump power demand vary as a function of the pitch of the vanes;

b) a mechanism structured for coupling the pump to the external motor for driving the pump; and a spherical impeller having the plurality of vanes, the spherical impeller residing within a substantially spherical housing structured to maintain close fits with tips of the vanes over a range of vane pitch.

2. The apparatus of claim 1, further comprising a spherical hub that is concentric to the spherical housing, and a substantially uniform water flow space between the spherical hub and the spherical housing.

3. The apparatus of claim 1, further comprising a vane pitch control mechanism coupled to the pump and structured for controlling the vane pitch within the range of vane pitch.

4. The apparatus of claim 3, further comprising a microcontroller coupled for controlling the vane pitch control mechanism.

5. An improved water jet propulsion apparatus for a jet propelled watercraft, the water jet propulsion apparatus comprising:

a) a variable-pitch propeller water pump structured for operating as a continuously variable power transmission for a motor external to the pump, the pump comprising a plurality of vanes and a mechanism structured for adjusting a pitch on the vanes in such manner that water flow and pump power demand vary as a function of the pitch of the vanes;

b) a mechanism structured for coupling the pump to the external motor for driving the pump; and wherein an outlet of the pump is coupled to an inlet of a variable orifice discharge nozzle, and an orifice control mechanism is coupled for controlling an orifice of the variable orifice discharge nozzle.

6. The apparatus of claim 5 wherein the orifice of the nozzle is further controlled to maintain a head affinity relationship of the pump.

7. An improved water jet propulsion system for a jet propelled watercraft, the water jet propulsion apparatus comprising:

a) water pump having a variable pitch impeller and being structured for being coupled to an external driver;

b) an inlet duct structured for receiving water from an external body of water and directing received water to the water pump, the inlet duct having a variable inlet orifice and an outlet orifice structured for being coupled to an inlet orifice of the water pump; and c) a discharge nozzle structured for receiving water from the water pump and discharging received water from a variable discharge orifice.

8. The system of claim 7, further comprising a pitch control mechanism structured for controlling a pitch of the variable pitch impeller of the pump to provide variable forward, neutral and reverse flows of received water.

9. The system of claim 7 wherein the variable pitch impeller of the pump is further structured for operating in zero and reverse pitch.

10. The system of claim 7 wherein leading and trailing edges of vanes of the variable pitch impeller are further structured to provide a cutting action therebetween at zero pitch.

11. The system of claim 7 wherein the variable pitch impeller further comprises a spherical impeller, and wherein the water pump further comprises a substantially spherical housing structured to maintain close fits with the spherical impeller over a range of vane pitch.

12. The system of claim 7 wherein the variable inlet orifice of the inlet duct further comprises a slide that is structured for reducing the variable inlet orifice and is further structured to elongate an enclosed tunnel between the variable inlet orifice and the outlet orifice thereof.

13. The system of claim 7, further comprising a watercraft having the water pump, inlet duct and discharge nozzle installed therein, the variable inlet orifice of the inlet duct being coupled to a surface of the watercraft in a position for receiving water from an external body of water with the outlet orifice of the inlet duct being coupled to the inlet orifice of the water pump, and the discharge nozzle being coupled for receiving water from the water pump with the variable discharge orifice being coupled to a surface of the watercraft in a position for discharging therefrom water received from the water pump;

and an external driver coupled to drive the water pump.

14. A method of water jet propulsion for propelling a watercraft, the method comprising:

a) in a water pump, providing a variable pitch impeller;

b) coupling an inlet duct to the water pump for receiving water into an inlet orifice thereof and directing received water to an inlet orifice of the water pump;

c) coupling a discharge nozzle to the water pump for receiving water from the water pump and discharging the received water from a discharge orifice thereof; and d) varying at least one of the inlet orifice of the inlet duct and the discharge orifice of the discharge nozzle.

15. The method claim 14 wherein the method further comprises varying a pitch of the variable pitch impeller between different forward, zero and reverse pitches.

16. The method claim 14 wherein the method further comprises controlling a pitch of the variable pitch impeller in combination with controlling one of a variable inlet orifice of the inlet duct, and a variable discharge orifice of the discharge nozzle.

17. The method claim 14 wherein the method further comprises:

coupling the inlet orifice of the inlet duct to a surface of a watercraft in a position for receiving water from an external body of water;

coupling the discharge orifice of the discharge nozzle to a surface of the watercraft in a position for discharging therefrom received water; and coupling to the water pump an external power supply for driving the water pump.

18. An improved water jet propulsion system for a jet propelled watercraft, the water jet propulsion apparatus comprising:

a) water pump being structured for being coupled to an external driver;

b) a inlet duct structured for receiving water from an external body of water and directing received water to the water pump, the inlet duct having an elongated inlet tunnel between a variable inlet orifice and an outlet orifice structured for being coupled to an inlet orifice of the water pump;

c) a grate structure internal of the inlet duct and positioned within the elongated inlet tunnel; and d) a discharge nozzle structured for receiving water from the water pump and discharging received water from a variable discharge orifice.

19. A jet propelled watercraft, comprising:

a watercraft;

a water pump having a variable pitch impeller;

a power supply coupled for driving the water pump;

an inlet duct having a variable inlet orifice coupled to a first surface of the watercraft in a position for receiving water and directing received water to an inlet orifice of the water pump;

a discharge nozzle coupled to the water pump for receiving water from the water pump, and coupled to a second surface of the watercraft in a position for discharging the received water from a discharge orifice thereof.

20. The watercraft of claim 19 wherein the variable pitch impeller further comprises a spherical impeller, and wherein the water pump further comprises a substantially spherical housing structured to maintain close fits with the spherical impeller over a range of vane pitch.

21. The watercraft of claim 19 wherein the discharge orifice further comprises a variable discharge orifice.

* * * * *